US010914065B2

(12) United States Patent
Pilz

(10) Patent No.: US 10,914,065 B2
(45) Date of Patent: Feb. 9, 2021

(54) WALL JOINT OR SOUND BLOCK COMPONENT AND WALL ASSEMBLIES

(71) Applicant: CALIFORNIA EXPANDED METAL PRODUCTS COMPANY, City of Industry, CA (US)

(72) Inventor: Donald Anthony Pilz, Livermore, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 0 days.

(21) Appl. No.: 16/598,211

(22) Filed: Oct. 10, 2019

(65) Prior Publication Data

US 2020/0240140 A1 Jul. 30, 2020

Related U.S. Application Data

(60) Provisional application No. 62/796,500, filed on Jan. 24, 2019.

(51) Int. Cl.

| | |
|---|---|
| ***E04B 2/74*** | (2006.01) |
| ***E04B 1/94*** | (2006.01) |
| ***E04B 1/88*** | (2006.01) |

(52) U.S. Cl.

CPC ..... *E04B 2/7414* (2013.01); *E04B 1/88* (2013.01); *E04B 1/948* (2013.01); *E04B 2/7411* (2013.01); *E04B 1/943* (2013.01)

(58) Field of Classification Search

CPC . E04B 1/88; E04B 1/948; E04B 1/943; E04B 2/7414; E04B 2/7411

See application file for complete search history.

(56) References Cited

U.S. PATENT DOCUMENTS

| | | | |
|---|---|---|---|
| 1,130,722 | A | 3/1915 | Fletcher |
| 1,563,651 | A | 12/1925 | Pomerantz |

(Continued)

FOREIGN PATENT DOCUMENTS

| | | |
|---|---|---|
| CA | 2234347 | 10/1999 |
| CA | 2697295 | 12/2013 |

(Continued)

OTHER PUBLICATIONS

US 9,085,895 B1, 07/2015, Pilz et al. (withdrawn)

(Continued)

*Primary Examiner* — Adriana Figueroa

(74) *Attorney, Agent, or Firm* — Knobbe Martens Olson & Bear LLP

(57) ABSTRACT

An elongate component for placement in a wall gap and a wall incorporating such a component. The component includes a wall-face leg configured to extend along a face of a wallboard and a wall-end leg configured to extend along an end of the wallboard. The wall-end leg is oriented perpendicular to the wall-face leg. The component further includes a flexible gap portion configured to be positioned within and extend along the wall gap. The gap portion is located on an opposite side of the wall-end leg relative to the wall-face leg. A blocking element is located in a space defined by the wall-end leg and the gap portion. The blocking element is configured to block fire and/or sound within the wall gap. At least a portion of the flexible gap portion is located on an exterior side of the blocking element.

20 Claims, 12 Drawing Sheets

(56) References Cited

U.S. PATENT DOCUMENTS 2,105,771 A 1/1938 Holdsworth
2,218,426 A 10/1940 Hulbert, Jr.
2,683,927 A 7/1954 Maronek
2,733,786 A 2/1956 Drake
3,019,866 A 2/1962 Grabowski
3,129,792 A 4/1964 Gwynne
3,271,920 A 9/1966 Downing, Jr.
3,309,826 A 3/1967 Zinn
3,324,615 A 6/1967 Zinn
3,355,852 A 12/1967 Lally
3,397,495 A 8/1968 Thompson
3,481,090 A 12/1969 Lizee
3,537,219 A 11/1970 Navarre
3,562,985 A 2/1971 Nicosia
3,566,559 A 3/1971 Dickson
3,648,419 A 3/1972 Marks
3,668,041 A 6/1972 Lonning
3,707,819 A 1/1973 Calhoun et al.
3,730,477 A 5/1973 Wavrunek
3,744,199 A 7/1973 Navarre
3,757,480 A 9/1973 Young
3,786,604 A 1/1974 Kramer
3,837,126 A 9/1974 Voiturier et al.
3,839,839 A 10/1974 Tillisch et al.
3,908,328 A 9/1975 Nelsson
3,921,346 A 11/1975 Sauer et al.
3,922,830 A 12/1975 Guarino et al.
3,934,066 A 1/1976 Murch
3,935,681 A 2/1976 Voiturier et al.
3,955,330 A 5/1976 Wendt
3,964,214 A 6/1976 Wendt
3,974,607 A 8/1976 Balinski
3,976,825 A 8/1976 Anderberg
4,011,704 A 3/1977 O'Konski
4,103,463 A 8/1978 Dixon
4,122,203 A 10/1978 Stahl
4,130,972 A 12/1978 Varlonga
4,139,664 A 2/1979 Wenrick
4,144,335 A 3/1979 Edwards
4,144,385 A 3/1979 Downing
4,152,878 A 5/1979 Balinski
4,164,107 A 8/1979 Kraemling et al.
4,178,728 A 12/1979 Ortmanns et al.
4,203,264 A 5/1980 Kiefer et al.
4,276,332 A 6/1981 Castle
4,283,892 A 8/1981 Brown
4,318,253 A 3/1982 Wedel
4,329,820 A 5/1982 Wendt
4,356,672 A 11/1982 Beckman et al.
4,361,994 A 12/1982 Carver
4,424,653 A 1/1984 Heinen
4,434,592 A 3/1984 Reneault et al.
4,437,274 A 3/1984 Slocum et al.
4,454,690 A 6/1984 Dixon
4,495,238 A 1/1985 Adiletta
4,575,979 A 3/1986 Mariani
4,598,516 A 7/1986 Groshong
4,622,794 A 11/1986 Geortner
4,632,865 A 12/1986 Tzur
4,649,089 A 3/1987 Thwaites
4,672,785 A 6/1987 Salvo
4,709,517 A 12/1987 Mitchell et al.
4,711,183 A 12/1987 Handler et al.
4,723,385 A 2/1988 Kallstrom
4,756,945 A 7/1988 Gibb
4,761,927 A 8/1988 O'Keeffe et al.
4,787,767 A 11/1988 Wendt
4,805,364 A 2/1989 Smolik
4,822,659 A 4/1989 Anderson et al.
4,825,610 A 5/1989 Gasteiger
4,845,904 A 7/1989 Menchetti
4,850,385 A 7/1989 Harbeke
4,854,096 A 8/1989 Smolik
4,866,898 A 9/1989 LaRoche et al.
4,881,352 A 11/1989 Glockenstein
4,885,884 A 12/1989 Schilger
4,899,510 A 2/1990 Propst
4,914,880 A 4/1990 Albertini
4,918,761 A 4/1990 Harbeke
4,930,276 A 6/1990 Bawa et al.
4,935,281 A 6/1990 Tolbert et al.
5,010,702 A 4/1991 Daw et al.
5,090,170 A 2/1992 Propst
5,094,780 A 3/1992 von Bonin
5,103,589 A 4/1992 Crawford
5,125,203 A 6/1992 Daw
5,127,203 A 7/1992 Paquette
5,127,760 A 7/1992 Brady
5,146,723 A 9/1992 Greenwood et al.
5,155,957 A 10/1992 Robertson et al.
5,157,883 A 10/1992 Meyer
5,167,876 A 12/1992 Lem
5,173,515 A 12/1992 von Bonin et al.
5,203,132 A 4/1993 Smolik
5,212,914 A 5/1993 Martin et al.
5,222,335 A 6/1993 Petrecca
5,244,709 A 9/1993 Vanderstukken
5,285,615 A 2/1994 Gilmour
5,315,804 A 5/1994 Attalla
5,325,651 A 7/1994 Meyer et al.
5,347,780 A 9/1994 Richards et al.
5,367,850 A 11/1994 Nicholas
5,374,036 A 12/1994 Rogers et al.
5,376,429 A 12/1994 McGroarty
5,390,458 A 2/1995 Menchetti
5,390,465 A 2/1995 Rajecki
5,394,665 A 3/1995 Johnson
5,412,919 A 5/1995 Pellock et al.
5,452,551 A 9/1995 Charland et al.
5,454,203 A 10/1995 Turner
5,456,050 A 10/1995 Ward
5,460,864 A 10/1995 Heitkamp
5,471,791 A 12/1995 Keller
5,471,805 A 12/1995 Becker
5,477,652 A 12/1995 Torrey et al.
5,502,937 A * 4/1996 Wilson ..... B32B 15/14 52/273
5,552,185 A 9/1996 De Keyser
5,592,796 A 1/1997 Landers
5,604,024 A 2/1997 von Bonin
5,644,877 A 7/1997 Wood
5,687,538 A 11/1997 Frobosilo et al.
5,689,922 A 11/1997 Daudet
5,709,821 A 1/1998 von Bonin et al.
5,724,784 A 3/1998 Menchetti
5,735,100 A 4/1998 Campbell
5,740,635 A 4/1998 Gil et al.
5,740,643 A 4/1998 Huntley
5,755,066 A 5/1998 Becker
5,765,332 A * 6/1998 Landin ..... E04B 1/948 52/235
5,787,651 A 8/1998 Horn et al.
5,797,233 A 8/1998 Hascall
5,806,261 A 9/1998 Huebner et al.
5,822,935 A 10/1998 Mitchell et al.
5,870,866 A 2/1999 Herndon
5,913,788 A 6/1999 Herren
5,921,041 A 7/1999 Egri, II
5,927,041 A 7/1999 Sedlmeier et al.
5,930,963 A 8/1999 Nichols
5,930,968 A 8/1999 Pullman
5,945,182 A 8/1999 Fowler et al.
5,950,385 A 9/1999 Herren
5,968,615 A 10/1999 Schlappa
5,968,669 A 10/1999 Liu et al.
5,970,672 A 10/1999 Robinson
5,974,750 A 11/1999 Landin et al.
5,974,753 A 11/1999 Hsu
6,023,898 A 2/2000 Josey
6,058,668 A * 5/2000 Herren ..... E04B 2/825 52/236.7
6,061,985 A 5/2000 Kraus et al.
6,110,559 A 8/2000 De Keyser
6,116,404 A 9/2000 Heuft et al.

(56) References Cited

U.S. PATENT DOCUMENTS 6,119,411 A 9/2000 Mateu Gil et al.
6,128,874 A 10/2000 Olson et al.
6,131,352 A 10/2000 Barnes et al.
6,151,858 A 11/2000 Ruiz et al.
6,153,668 A 11/2000 Gestner et al.
6,176,053 B1 1/2001 St. Germain
6,182,407 B1 2/2001 Turpin et al.
6,189,277 B1 2/2001 Boscamp
6,207,077 B1 3/2001 Burnell-Jones
6,207,085 B1 3/2001 Ackerman
6,213,679 B1 4/2001 Frobosilo et al.
6,216,404 B1 4/2001 Vellrath
6,233,888 B1 5/2001 Wu
6,256,948 B1 7/2001 Van Dreumel
6,256,960 B1 7/2001 Babcock et al.
6,279,289 B1 8/2001 Soder et al.
6,305,133 B1 10/2001 Cornwall
6,318,044 B1 11/2001 Campbell
6,374,558 B1 4/2002 Surowiecki
6,381,913 B2 5/2002 Herren
6,405,502 B1 6/2002 Cornwall
6,430,881 B1 8/2002 Daudet et al.
6,470,638 B1 10/2002 Larson
6,595,383 B2 7/2003 Pietrantoni
6,606,831 B2 8/2003 Degelsegger
6,647,691 B2 11/2003 Becker et al.
6,668,499 B2 12/2003 Degelsegger
6,679,015 B1 1/2004 Cornwall
6,698,146 B2 3/2004 Morgan et al.
6,705,047 B2 3/2004 Yulkowski
6,711,871 B2 3/2004 Beirise et al.
6,732,481 B2 5/2004 Stahl, Sr.
6,739,926 B2 5/2004 Riach et al.
6,748,705 B2 6/2004 Orszulak
6,783,345 B2 8/2004 Morgan et al.
6,799,404 B2 10/2004 Spransy
6,843,035 B1 1/2005 Glynn
6,854,237 B2 2/2005 Surowiecki
6,871,470 B1 3/2005 Stover
6,951,162 B1 10/2005 Shockey et al.
7,043,880 B2 5/2006 Morgan et al.
7,059,092 B2 6/2006 Harkins et al.
7,104,024 B1 9/2006 deGirolamo et al.
7,152,385 B2 12/2006 Morgan et al.
7,191,845 B2 3/2007 Loar
7,240,905 B1 7/2007 Stahl
7,251,918 B2 8/2007 Reif et al.
7,302,776 B2 12/2007 Duncan et al.
7,398,856 B2 7/2008 Foster et al.
7,413,024 B1 8/2008 Simontacchi et al.
7,487,591 B2 2/2009 Harkins et al.
7,506,478 B2 3/2009 Bobenhausen
7,513,082 B2 4/2009 Johnson
7,540,118 B2 6/2009 Jensen
7,594,331 B2 9/2009 Andrews et al.
7,603,823 B2 10/2009 Cann
7,610,725 B2 11/2009 Willert
7,617,643 B2 11/2009 Pilz et al.
7,681,365 B2 3/2010 Klein
7,685,792 B2 3/2010 Stahl, Sr. et al.
7,716,891 B2 5/2010 Radford
7,752,817 B2 7/2010 Pilz et al.
7,775,006 B2 8/2010 Giannos
7,776,170 B2 8/2010 Yu et al.
7,797,893 B2 9/2010 Stahl, Sr. et al.
7,810,295 B2 10/2010 Thompson
7,814,718 B2 10/2010 Klein
7,827,738 B2 11/2010 Abrams et al.
7,866,108 B2 1/2011 Klein
7,870,698 B2 1/2011 Tonyan et al.
7,921,614 B2 4/2011 Fortin et al.
7,941,981 B2 5/2011 Shaw
7,950,198 B2 5/2011 Pilz et al.
7,984,592 B1 7/2011 Jiras
8,056,293 B2 11/2011 Klein
8,061,099 B2 11/2011 Andrews
8,062,108 B2 11/2011 Carlson et al.
8,069,625 B2 12/2011 Harkins et al.
8,074,412 B1 12/2011 Gogan et al.
8,074,416 B2 12/2011 Andrews
8,087,205 B2 1/2012 Pilz et al.
8,100,164 B2 1/2012 Goodman et al.
8,132,376 B2 3/2012 Pilz et al.
8,136,314 B2 3/2012 Klein
8,151,526 B2 4/2012 Klein
8,181,404 B2 5/2012 Klein
8,225,581 B2 7/2012 Strickland et al.
8,281,552 B2 10/2012 Pilz et al.
8,322,094 B2 12/2012 Pilz et al.
8,353,139 B2 1/2013 Pilz
8,375,666 B2 2/2013 Stahl, Jr. et al.
8,413,394 B2 4/2013 Pilz et al.
8,495,844 B1 7/2013 Johnson
8,499,512 B2 8/2013 Pilz et al.
8,555,566 B2 10/2013 Pilz et al.
8,578,672 B2 11/2013 Mattox et al.
8,584,415 B2 11/2013 Stahl, Jr. et al.
8,590,231 B2 11/2013 Pilz
8,595,999 B1 12/2013 Pilz et al.
8,596,019 B2 12/2013 Aitken
8,607,519 B2 12/2013 Hilburn
8,640,415 B2 2/2014 Pilz et al.
8,646,235 B2 2/2014 Hilburn, Jr.
8,671,632 B2 3/2014 Pilz et al.
8,728,608 B2 5/2014 Maisch
8,793,947 B2 8/2014 Pilz et al.
8,938,922 B2 1/2015 Pilz et al.
8,973,319 B2 3/2015 Pilz et al.
9,045,899 B2 6/2015 Pilz et al.
9,085,907 B2 7/2015 Rutherford
9,127,454 B2 9/2015 Pilz et al.
9,151,042 B2 10/2015 Simon et al.
9,206,596 B1 12/2015 Robinson
9,290,932 B2 3/2016 Pilz et al.
9,290,934 B2 3/2016 Pilz et al.
9,371,644 B2 6/2016 Pilz et al.
9,458,628 B2 10/2016 Pilz et al.
9,481,998 B2 11/2016 Pilz et al.
9,512,614 B2 12/2016 Klein et al.
9,523,193 B2 12/2016 Pilz
9,551,148 B2 1/2017 Pilz
9,616,259 B2 4/2017 Pilz et al.
9,637,914 B2 5/2017 Pilz et al.
9,683,364 B2 6/2017 Pilz et al.
9,719,253 B2 8/2017 Stahl, Jr. et al.
9,739,052 B2 8/2017 Pilz et al.
9,739,054 B2 8/2017 Pilz et al.
9,752,318 B2 9/2017 Pilz
9,879,421 B2 * 1/2018 Pilz ..... E04B 2/7411
9,909,298 B2 3/2018 Pilz
9,931,527 B2 4/2018 Pilz et al.
9,995,039 B2 6/2018 Pilz et al.
10,000,923 B2 6/2018 Pilz
10,011,983 B2 7/2018 Pilz et al.
10,077,550 B2 9/2018 Pilz
10,184,246 B2 1/2019 Pilz et al.
10,214,901 B2 2/2019 Pilz et al.
10,227,775 B2 3/2019 Pilz et al.
10,246,871 B2 4/2019 Pilz
10,406,389 B2 9/2019 Pilz et al.
10,494,818 B2 12/2019 Maziarz
10,563,399 B2 2/2020 Pilz et al.
10,619,347 B2 4/2020 Pilz et al.
10,689,842 B2 6/2020 Pilz
2002/0029535 A1 3/2002 Loper
2002/0139060 A1 10/2002 Contreras et al.
2002/0160149 A1 10/2002 Garofalo
2002/0170249 A1 11/2002 Yulkowski
2003/0079425 A1 5/2003 Morgan et al.
2003/0089062 A1 5/2003 Morgan et al.
2003/0196401 A1 10/2003 Surowiecki
2003/0213211 A1 11/2003 Morgan et al.
2004/0010998 A1 1/2004 Turco
2004/0016191 A1 1/2004 Whitty

(56) References Cited

U.S. PATENT DOCUMENTS

| | | | | |
|---|---|---|---|---|
| 2004/0045234 | A1 | 3/2004 | Morgan et al. | |
| 2004/0139684 | A1 | 7/2004 | Menendez | |
| 2004/0211150 | A1 | 10/2004 | Bobenhausen | |
| 2005/0183361 | A1 | 8/2005 | Frezza | |
| 2005/0246973 | A1 | 11/2005 | Jensen | |
| 2006/0032163 | A1 | 2/2006 | Korn | |
| 2006/0123723 | A1 | 6/2006 | Weir et al. | |
| 2006/0137293 | A1 | 6/2006 | Klein | |
| 2006/0213138 | A1 | 9/2006 | Milani et al. | |
| 2007/0056245 | A1 | 3/2007 | Edmondson | |
| 2007/0068101 | A1 | 3/2007 | Weir et al. | |
| 2007/0130873 | A1 | 6/2007 | Fisher | |
| 2007/0193202 | A1 | 8/2007 | Rice | |
| 2007/0261343 | A1 | 11/2007 | Stahl, Sr. | |
| 2008/0087366 | A1 | 4/2008 | Yu et al. | |
| 2008/0134589 | A1 | 6/2008 | Abrams et al. | |
| 2008/0172967 | A1 | 7/2008 | Hilburn | |
| 2008/0196337 | A1 | 8/2008 | Surowiecki | |
| 2008/0250738 | A1 | 10/2008 | Howchin | |
| 2009/0223159 | A1 | 9/2009 | Colon | |
| 2010/0199583 | A1 | 8/2010 | Behrens et al. | |
| 2011/0011019 | A1 | 1/2011 | Stahl, Jr. et al. | |
| 2011/0041415 | A1 | 2/2011 | Esposito | |
| 2011/0056163 | A1 | 3/2011 | Kure | |
| 2011/0067328 | A1 | 3/2011 | Naccarato et al. | |
| 2011/0099928 | A1 | 5/2011 | Klein et al. | |
| 2011/0146180 | A1 | 6/2011 | Klein | |
| 2011/0167742 | A1 | 7/2011 | Klein | |
| 2011/0185656 | A1 | 8/2011 | Klein | |
| 2011/0214371 | A1 | 9/2011 | Klein | |
| 2012/0023846 | A1 | 2/2012 | Mattox et al. | |
| 2012/0180414 | A1* | 7/2012 | Burgess | E04B 2/90 52/300 |
| 2012/0247038 | A1 | 10/2012 | Black | |
| 2012/0266550 | A1 | 10/2012 | Naccarato et al. | |
| 2012/0297710 | A1 | 11/2012 | Klein | |
| 2013/0205694 | A1 | 8/2013 | Stahl, Jr. | |
| 2014/0219719 | A1 | 8/2014 | Hensley et al. | |
| 2015/0135631 | A1 | 5/2015 | Foerg | |
| 2015/0275506 | A1* | 10/2015 | Klein | E04B 1/68 277/628 |
| 2015/0275507 | A1 | 10/2015 | Klein et al. | |
| 2015/0275510 | A1 | 10/2015 | Klein et al. | |
| 2016/0017598 | A1 | 1/2016 | Klein et al. | |
| 2016/0017599 | A1 | 1/2016 | Klein et al. | |
| 2016/0265219 | A1 | 9/2016 | Pilz | |
| 2017/0016227 | A1 | 1/2017 | Klein | |
| 2017/0175386 | A1 | 6/2017 | Pilz | |
| 2017/0260741 | A1 | 9/2017 | Ackerman et al. | |
| 2017/0306615 | A1 | 10/2017 | Klein et al. | |
| 2018/0010333 | A1 | 1/2018 | Foerg | |
| 2018/0044913 | A1 | 2/2018 | Klein et al. | |
| 2018/0051470 | A1 | 2/2018 | Smith | |
| 2018/0171624 | A1 | 6/2018 | Klein et al. | |
| 2018/0171646 | A1 | 6/2018 | Stahl et al. | |
| 2018/0195282 | A1 | 7/2018 | Pilz | |
| 2018/0291619 | A1 | 10/2018 | Ackerman et al. | |
| 2018/0347189 | A1 | 12/2018 | Pilz | |
| 2018/0363293 | A1 | 12/2018 | Pilz | |
| 2019/0284797 | A1 | 9/2019 | Pilz | |
| 2019/0316348 | A1 | 10/2019 | Pilz | |
| 2019/0316350 | A1 | 10/2019 | Pilz | |
| 2019/0330842 | A1 | 10/2019 | Pilz | |
| 2019/0338513 | A1 | 11/2019 | Pilz | |
| 2019/0344103 | A1 | 11/2019 | Pilz | |
| 2019/0360195 | A1 | 11/2019 | Pilz et al. | |

FOREIGN PATENT DOCUMENTS

| | | | | |
|---|---|---|---|---|
| CA | 2736834 | 12/2015 | | |
| CA | 2803439 | 3/2017 | | |
| CA | 3010414 | 8/2017 | | |
| CA | 2827183 | 7/2018 | | |
| CA | 3036429 | 9/2019 | | |
| CA | 3041494 | 10/2019 | | |
| CA | 3058865 | 7/2020 | | |
| EP | 0 346 126 | 12/1989 | | |
| GB | 2 159 051 | 11/1985 | | |
| GB | 2 411 212 | 8/2005 | | |
| GB | 2424658 | A * 10/2006 | | E04B 1/7046 |
| JP | 06-146433 | 5/1994 | | |
| JP | 06-220934 | 8/1994 | | |
| WO | WO 2003/038206 | 5/2003 | | |
| WO | WO 2007/103331 | 9/2007 | | |
| WO | WO 2009/026464 | 2/2009 | | |
| WO | WO 2016/128301 | 8/2016 | | |
| WO | WO 2017/129398 | 8/2017 | | |

OTHER PUBLICATIONS

BlazeFrame 2009 catalog of products, available at least as of Mar. 4, 2010 from www.blazeframe.com, in 20 pages.

Canadian First Office Action for Application No. 2,697,295, dated Sep. 21, 2011, in 4 pages.

Canadian Second Office Action for Application No. 2,697,295, dated May 23, 2012, in 4 pages.

Canadian Office Action for Application No. 2,827,183, dated Mar. 27, 2015 in 4 pages.

Canadian Office Action for Application No. 2,827,183, dated Mar. 7, 2016 in 4 pages.

Canadian Office Action for Application No. 2,802,579, dated Jan. 3, 2019 in 3 pages.

Catalog page from Stockton Products, printed from www.stocktonproducts.com, on Dec. 16, 2007, showing #5 Drip, in 1 page.

ClarkDietrich Building Systems, Product Submittal Sheet, (FTSC) Flat Trail Vertical Slide Clip. CD-FTSC11 Jul. 2011. 1 page.

DoubleTrackTM information sheets by Dietrich Metal Framing, in 2 pages; accessible on Internet Wayback Machine on Jul. 8, 2006.

FireStikTM by CEMCO Brochure, published on www.firestik.us, in 18 pages; accessible on Internet Wayback Machine on Aug. 13, 2007.

Information Disclosure Statement letter; U.S. Appl. No. 12/196,115, dated Aug. 4, 2011.

International Search Report for Application No. PCT/US2008/073920, dated Apr. 9, 2009.

"Intumescent Expansion Joint Seals", Astroflame; http://www.astroflame.com/intumescent_expansion_joint_seals; Jul. 2011; 4 pages.

James A. Klein's Answer, Affirmative Defenses and Counterclaims to Third Amended Complaint; U.S. District Court, Central District of California; Case No. 2:12-cv-10791-DDP-MRWx; Filed Sep. 17, 2014; pp. 1-37.

Letter from Thomas E. Loop; counsel for defendant; Jun. 26, 2015.

Expert Report of James William Jones and exhibits; Case No. CV12-10791 DDP (MRWx); May 18, 2015.

Letter from Ann G. Schoen of Frost Brown Todd, LLC; Jun. 24, 2015.

"System No. HW-D-0607", May 6, 2010, Metacaulk, www.rectorseal.com, www.metacault.com; 2008 Underwriters Laboratories Inc.; 2 pages.

Trim-Tex, Inc., TRIM-TEX Wall Mounted Deflection Bead Installation Instructions, 2 pages. [Undated. Applicant requests that the Examiner review and consider the reference as prior art for the purpose of examination.].

"Wall Mounted Deflection Bead," Trim-Tex Drywall Products; Oct. 9, 2016; 3 pages.

U.S. Appl. No. 15/848,068 File History, filed Dec. 20, 2017, downloaded on Dec. 6, 2019, through U.S. Office Action dated Oct. 29, 2019, in 266 pages, published as 2018/0171646.

"Wall Mounted Deflection Bead," Trim-Tex Drywall Products, Jul. 2016, 1 pg. (https://web.archive.org/web/20160710062112/https://www.trim-tex.com/products/overview/commercial-beads/deflection-beads/wall-mounted-deflection-bead/).

"CEMCO Hotrod Type-X Compressible Firestopping," CEMCO, Product Data Sheet, May 2019, 1 pg. (https://cemcosteel.com/steel-framming/head-wall/hot-rod-type-x).

U.S. Appl. No. 16/791,869, filed Feb. 14, 2020, Pilz et al.

(56) References Cited

OTHER PUBLICATIONS

U.S. Appl. No. 16/809,401, filed Mar. 4, 2020, Pilz.
U.S. Appl. No. 16/845,535, filed Apr. 10, 2020, Pilz et al.
U.S. Appl. No. 16/871,644, filed May 11, 2020, Pilz.

* cited by examiner

WALL JOINT OR SOUND BLOCK COMPONENT AND WALL ASSEMBLIES

PRIORITY

This application claims the benefit of U.S. Patent Application No. 62/796,500, filed Jan. 24, 2019, the entirety of which is hereby incorporated by reference.

BACKGROUND

Field

This disclosure generally relates to head-of-wall assemblies that include features and components that prevent or inhibit the passage of fire, smoke, and/or heat through a wall in accordance with UL-2079 regulations.

Description of Related Art

Fire-rated construction components and assemblies are common in the construction industry. These components and assemblies are aimed at inhibiting or preventing the passage of fire, heat, or smoke from one room to another or between portions of a building. Fire, heat and smoke generally move between vents, joints in the wall, or other openings between adjacent rooms. Accordingly, fire rated components often include fire retardant materials that substantially block the path of the fire, heat, or smoke for at least some period of time through the openings. Intumescent materials work well for this purpose because they swell and char when exposed to heat helping to create a barrier for the fire, heat, and/or smoke.

Walls in modern building structures can at least partially define or include many gaps or joints. Such gaps or joints can be located at the bottom of a wall, along the sides of a wall or within an interior of the wall. One particular wall joint with a high potential for allowing fire, heat, or smoke to pass from one room to another is the joint between a wall and a ceiling. This can be referred to as a head-of-wall joint. In modern construction, especially in multistory buildings, the head-of-wall joint is often a dynamic joint in which relative movement between ceiling and the wall is allowed. This relative movement can accommodate deflection in the building due to loading of the upper structures or ceiling, seismic forces, heat expansion or building movement.

SUMMARY

An aspect of the present disclosure involves an elongate component for placement in a wall gap. The component includes a wall-face leg configured to extend along a face of a wallboard. The component also includes a wall-end leg configured to extend along an end of the wallboard. The wall-end leg is oriented perpendicular to the wall-face leg. The component further includes a flexible gap portion configured to be positioned within and extend along the wall gap. The gap portion is located on an opposite side of the wall-end leg relative to the wall-face leg. A blocking element is located in a space defined by the wall-end leg and the gap portion. The blocking element is configured to block fire and/or sound within the wall gap. At least a portion of the flexible gap portion is located on an exterior side of the blocking element.

In some configurations, the flexible gap portion comprises a single leg.

In some configurations, the flexible gap portion comprises an enclosure.

In some configurations, the enclosure comprises a pair of legs.

In some configurations, each of the pair of legs comprises a bent free end.

In some configurations, the blocking element comprises a mineral wool material.

In some configurations, the blocking element further comprises a foam material.

In some configurations, the blocking element comprises a combination of an intumescent material strip and a foam block.

In some configurations, the intumescent material strip is attached to the wall-end leg.

In some configurations, the foam block has a height that is greater than a height of the flexible gap portion.

In some configurations, the blocking element comprises a mineral wool material.

In some configurations, the blocking element further comprises a foam material.

In some configurations, a wall assembly define a wall gap and the wall incorporates the component positioned in the wall gap.

In some configurations, the wall gap is a head of wall gap.

An aspect of the present disclosure involves a method of making a component for placement in a wall gap, comprising forming an elongate profile comprising a first leg and a second leg that cooperate to form an L-shape in cross-section and a flexible enclosure defining an interior space, and positioning a blocking member within the interior space of the enclosure.

In some configurations, the enclosure comprises a pair of flexible legs, further comprising separating the flexible legs and inserting the blocking member into the interior space between the flexible legs.

In some configurations, the blocking member comprises a mineral wool material.

In some configurations, the blocking member further comprises a foam material.

An aspect of the present disclosure involves a fire-rated assembly is configured to extend along an upper end of the wallboard and at least partially fill the deflection gap. The assembly includes a vinyl profile having a first leg extending upwardly from the upper edge of the wallboard, a second leg extending downwardly from the upper edge of the wallboard, and a third leg extending along the upper edge of the wallboard within the deflection gap. A compressible foam member is attached to one or both of the first leg and the third leg and is configured to contact an upper surface of an overhead structure within the deflection gap. A fire-blocking strip is attached to the third leg and is configured to be located within the deflection gap.

An aspect of the present disclosure involves a fire rated assembly is installed within a head-of-wall assembly. The head-of-wall assembly can include a header track coupled to the upper surface, the header track having a web and first and second flanges extending from the web in the same direction and forming a substantially U-shaped cross section. At least one stud is coupled to the header track. An upper end of the stud is located between the first and second flanges. A wallboard is coupled to the stud. The wallboard overlaps the first flange of the header track. The deflection gap is formed between the upper edge of the wallboard and the upper surface. The deflection gap is variable between a closed position and an open position.

In some configurations, the first and second legs are generally vertical and the third leg is generally horizontal.

In some configurations, the first leg is flexible.

In some configurations, the second leg is rigid.

In some configurations, the second leg includes a plurality of perforations.

In some configurations, the fire-blocking strip is or comprises an intumescent material.

In some configurations, the fire-blocking strip is above or below the third leg.

In some configurations, the fire-blocking strip is between the compressible foam member and third leg.

In some configurations, the compressible foam member has a height greater than a height of the first leg.

In some configurations, the second leg is attached to one of an outward face and an inward face of the wallboard.

An aspect of the present disclosure involves a fire-rated assembly is configured to extend along an upper edge of a wallboard and at least partially fill a deflection gap along the upper edge of the wallboard. The assembly includes a vinyl profile, the vinyl profile has a first leg configured to extend upwardly from the upper edge of the wallboard, a second leg configured to extend downwardly from the upper edge of the wallboard, and a third leg configured to extend along the upper edge of the wallboard within the deflection gap. A compressible foam member is attached to the third leg and is configured to contact an upper surface of an overhead structure within the deflection gap. A fire-blocking strip is attached to one or both of the first leg and the third leg and is configured to be located within the deflection gap.

In some configurations, the first and second legs are generally vertical and the third leg is generally horizontal.

In some configurations, the first leg is flexible.

In some configurations, the second leg is rigid.

In some configurations, the second leg includes a plurality of perforations.

In some configurations, the fire-blocking strip is or comprises an intumescent material.

In some configurations, the fire-blocking strip is above or below the third leg.

In some configurations, the fire-blocking strip is between the compressible foam member and third leg.

In some configurations, the compressible foam member has a height greater than a height of the first leg.

In some configurations, the second leg is configured to attach to one of an outward face and an inward face of the wallboard.

The foregoing summary is illustrative only and is not intended to be limiting. Other aspects, features, and advantages of the systems, devices, and methods and/or other subject matter described in this application will become apparent in the teachings set forth below. The summary is provided to introduce a selection of some of the concepts of this disclosure. The summary is not intended to identify key or essential features of any subject matter described herein.

BRIEF DESCRIPTION OF THE DRAWINGS

Various embodiments are depicted in the accompanying drawings for illustrative purposes, and should in no way be interpreted as limiting the scope of the embodiments. Various features of different disclosed embodiments can be combined to form additional embodiments, which are part of this disclosure.

DETAILED DESCRIPTION

The various features and advantages of the systems, devices, and methods of the technology described herein will become more fully apparent from the following description of the embodiments illustrated in the figures. These embodiments are intended to illustrate the principles of this disclosure, and this disclosure should not be limited to merely the illustrated examples. The features of the illustrated embodiments can be modified, combined, removed, and/or substituted as will be apparent to those of ordinary skill in the art upon consideration of the principles disclosed herein.

Figure 1:
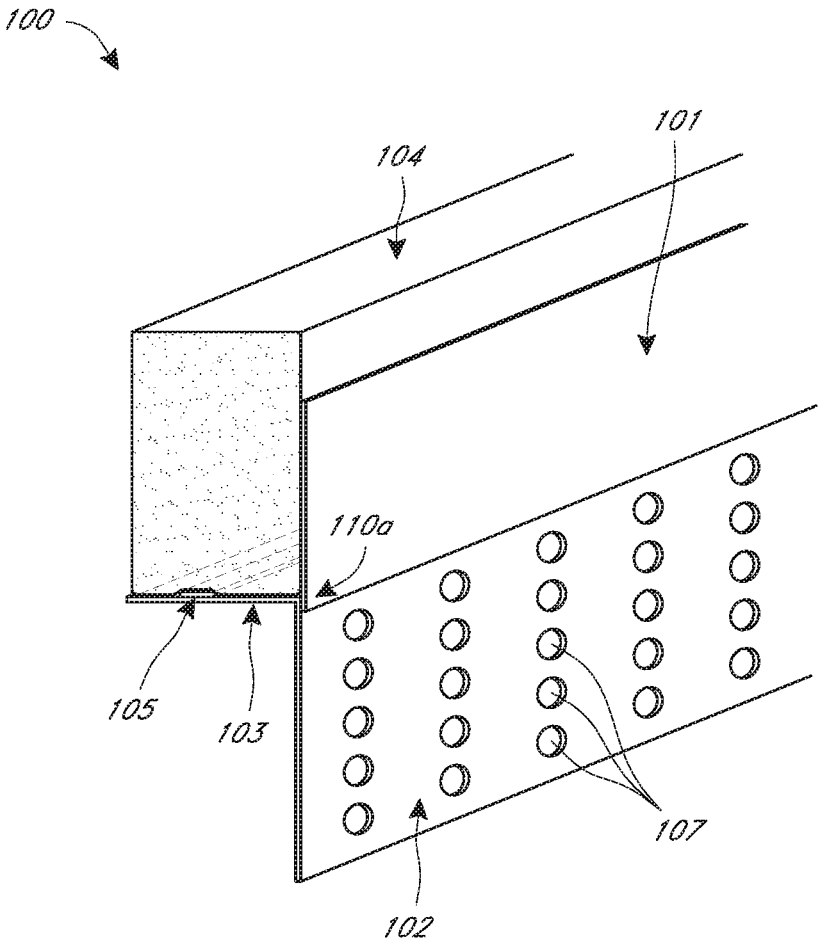
FIG. 1 shows a perspective view of a fire-rated assembly.
Figure 2:
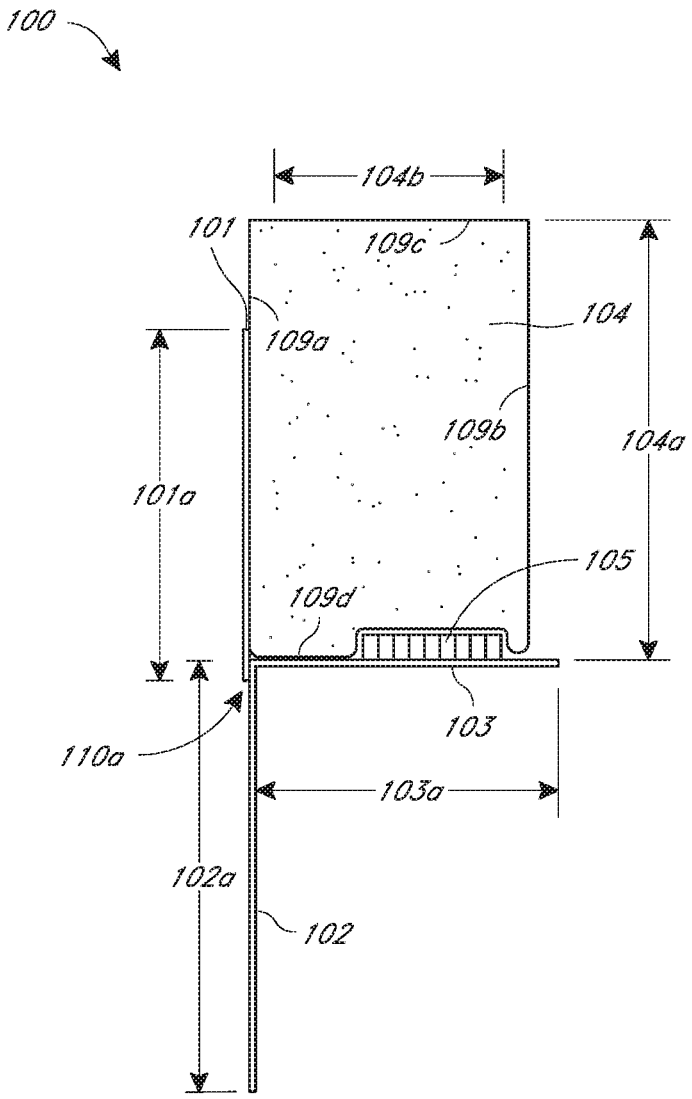
FIG. 2 shows an end view of an opposite end of the fire-rated assembly of FIG. 1.

FIGS. 1-2 show a fire-rated assembly 100. The fire-rated assembly 100 can be an assembly of various components, strips and/or layers. The fire-rated assembly 100 can include a profile 110. The profile 110 can comprise a metal or polymer material, such as vinyl (e.g., polyvinyl chloride (PVC)). The profile 110 can comprise a single material or multiple materials connected together (e.g., co-extruded). The profile 110 can be sold in standard lengths, (e.g., 10', 12', 15', etc.).

The profile 110 can comprise a plurality of legs. The legs can variously be stiff or flexible depending on their purpose and intended usage of each of the legs in a head-of-wall assembly. The legs can generally form a T-shaped cross-section having one or more horizontal and/or vertical legs. In certain implementations, the profile 110 can have a uniform cross-sectional Y-shape along its entire length. The legs can connect at an intersection 110*a*. The legs can each be formed integrally or connected to the profile 110 (e.g., at the intersection 110*a*.).

The profile 110 can include a first leg 101 or a gap portion, which is configured to extend along a wall gap. The first leg 101 can be a flexible leg. The first leg 101 can extend in a first direction, such as a generally upward direction (e.g., as shown in FIGS. 1-2) from the intersection 110*a*. The first leg 101 can be an upper leg. In certain implementations, the first leg 101 can be formed of the same material as the remainder of the profile 110. The first leg 101 can be formed as a unitary piece of the profile 110. In certain implementations, the first leg 101 can be formed of a different material than another portion or the remainder of the profile 110 and connected thereto (e.g., through a co-extrusion process). The different material can comprise a polymer, such as PVC, having different properties than the profile 110 (e.g., relative flexibility or stiffness).

The profile 110 can include a second leg 102 or a wall-face leg, which can extend along an outer face of a wall or wallboard. The second leg 102 can extend in a second direction, such as a generally downward direction relative to the intersection 110*a* and/or the first leg 101. The second leg 102 can be generally rigid relative to the first leg 101. The second leg 102 can be a lower leg. The second leg 102 can comprise a plurality of perforations 107. The perforations 107 can be apertures extending through a thickness of the second leg 102. The apertures 107 can be arrayed in a pattern extending along a length of the second leg 102. In certain implementations, the second leg 102 can be formed as a unitary piece (e.g., through an extrusion process) with another portion or the remainder of the profile 110.

The first leg 101 and the second leg 102 can connect at the intersection 110*a* of the profile 110. The first leg 101 and the second leg 102 can be offset (e.g., horizontally, as illustrated) at the intersection 110*a*. In certain alternative implementations, the first leg 101 and the second leg 102 can be aligned.

The profile 110 can include a third leg 103 or a wall-end leg, which can extend along an end of a wallboard. The third leg 103 can be a horizontal leg. The third leg 103 can extend in a third direction, such as a generally horizontal direction relative to the intersection 110*a* and/or the first and second legs 101, 102. The third leg 103 can connect to the first leg 101 and/or the second leg 102 at the intersection 110*a*. In certain implementations, the third leg 103 can be formed as a unitary piece (e.g., through an extrusion process) with the second leg 102 and the first leg 101 and can be connected thereto at the intersection 110*a*.

The fire-rated assembly 100 can comprise a compressible member in the form of a compressible block 104. The compressible block can be coupled with one or both of the first leg 101 and the third leg 103. The compressible block 104 can be an open or closed cell polymer foam, or another suitable material. The compressible block 104 can extend along the length of the profile 110. The compressible block 104 can be abutted against and/or attached with an inner side of the first leg 101. The compressible block 104 can be abutted against and/or attached with an upper side of the third leg 103. In certain implementations, the compressible block 104 can be attached to the profile 110 with an adhesive.

The fire-rated assembly 100 can include a fire-blocking strip member, such as a fire-blocking 105. The fire-blocking strip 105 can be attached or coupled to the third leg 103. The fire-blocking strip 105 can be attached or coupled to the upper side of the third leg 103 or a lower side of the third leg 103. Alternatively, the fire-blocking strip 105 can be attached to the first leg 101 (e.g., at the inner side thereof). The fire-blocking strip 105 can extend the entire length of the profile 110.

The fire-blocking strip 105 can be located anywhere along a width of the third leg 103. In certain implementations, the fire-blocking strip 105 can be aligned adjacent to the first leg 101, in a central portion of the third leg 103, along an end of the third leg 103 opposite the first leg 101, or span the entire third leg 103. The fire-blocking strip 105 can be located between the profile 110 and the compressible block 104. In certain embodiments, the fire-blocking strip 105 can be located between the compressible block 104 and the third leg 103. The compressible block 104 can partially or completely cover the fire-blocking strip 105. The compressible block 104 can be partially or fully attached to the profile 110 by its connection to the strip 105.

The first leg 101 can have a height or a length 101*a* in the cross-sectional direction. The length 101*a* can extend from a distal end of the first leg 101 to the intersection 110*a* of the first leg 101 with the third leg 103. The length 101*a* can be ⅝". In certain implementations, the length 101*a* can be between approximately ¼" and 1½" although other lengths are contemplated herein. The first leg 101 can have a thickness; the thickness can taper from the intersection 110*a* to the distal end of the first leg 101. The thickness and/or taper can provide for flexibility of the first leg 101.

The second leg 102 can have a height or a length 102*a* in the cross-sectional direction. The length 102*a* can be extended from a distal end of the second leg 102 to the intersection 110*a* of the second leg 102 with the third leg 103. In certain implementations, the length 102*a* can be between approximately 1" and 3". The length 102*a* can be greater than the length 101*a*. The second leg 102 can have a thickness. The thickness can be consistent from the intersection 110*a* to the distal end of the second leg 102. The thickness can provide for relative stiffness of the second leg 102.

The third leg 103 can have a width or a length 103*a* in the cross-sectional direction. The length 103*a* can extend from the intersection 110*a* with either of the first leg 101 or the second leg 102 to a distal end of the third leg 103. The length 103*a* can be ⅝". In certain implementations, the length 103*a* can be between approximately ¼" and 1½". The length 103*a* can be less than the length 101*a* and/or length 102*a*. The third leg 103 can have a thickness. The thickness can be consistent from the intersection 110*a* to the distal end of the third leg 103. The thickness can provide a relative stiffness or flexibility to the third leg 103.

The compressible block 104 can have a height 104*a*. The height 104*a* can be measured in a direction orthogonal to the length of 103*a* of the third leg 103. The height 104*a* can be in a direction parallel to the length 101*a* of the first leg 101. The height 104*a* can be 1". In certain implementations, the height 104*a* can be between approximately ½" and 2". Desirably, the height 104*a* can be greater than the length

101*a*. The compressible block 104 can extend upwardly past the first leg 101. However, this is not required.

The compressible block 104 can have a width 104*b*. The width 104*b* can be measured in a direction orthogonal the length 101*a* of to the first leg 101. The width 104*b* can be in a direction parallel to the length 103*a* of the third leg 103. The width 104*b* can be ½". In other implementations, the width 104 can be between approximately ¼" and 1½". The width 104*b* can be less than, equal to, or greater than the length 103*a* of the third leg 103.

The compressible block 104 can have a generally rectangular profile or cross-sectional shape, although this is not required. The compressible block 104 can include a front face 109*a*, a rear face 109*b*, an upper face 109*c*, and/or a lower face 109*d*. The front face 109*a* can abut or contact the inner side of the first leg 101. The front face 109*a* can be adhered to the first leg 101. The bottom face 109*d* can abut or contact the upper side of the third leg 103. The bottom face 109*d* can be attached or adhered to the third leg 103. The fire-blocking strip 105 can contact the lower face 109*d* of the compressible block 104. Alternatively, the fire-blocking strip 105 can be attached to the lower surface of the third leg 103.

Figure 3:
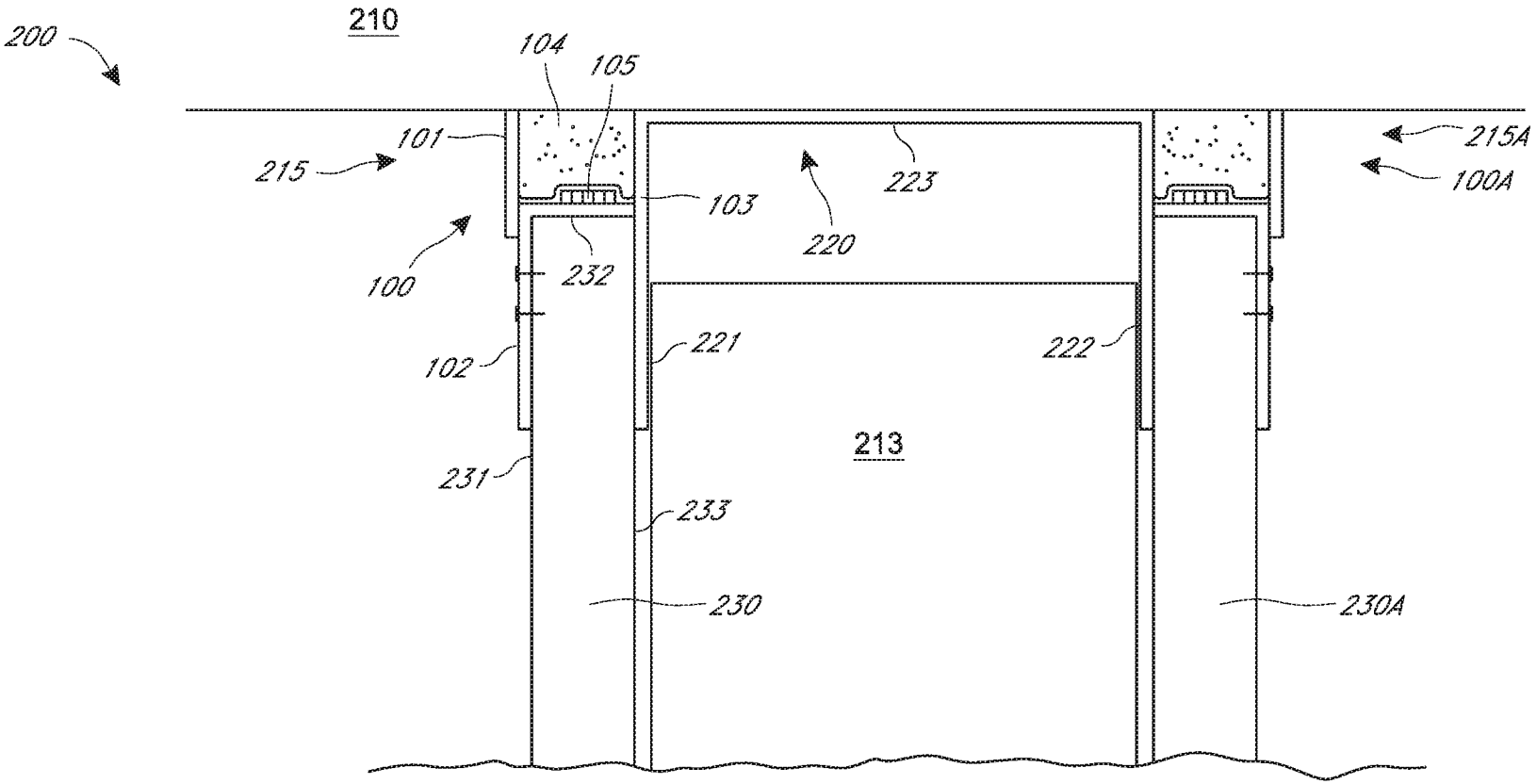
FIG. 3 shows a cross-sectional view of a head-of-wall assembly including the fire-rated assembly of FIG. 1.

The fire-rated assembly 100 can be installed within a wall joint in a building to provide fire, heat, smoke, and/or sound protection across the joint. As one exemplary usage environment, the fire-rated assembly 100 can be used to fire block a head-of-wall assembly 200, as shown in FIG. 3. The head-of-wall assembly 200 can include an upper or overhead structure 210 defining an upper surface. The upper structure 210 can be a ceiling or a floor of an upper level of a multi-level building. The head-of-wall assembly 200 can include a header track 220. The header track 220 can include first and second flanges 221, 222. The first and second flanges 221, 222 can be connected by a web 223. The header track 220 can be generally U-shaped. The flanges 221, 222 can include apertures or slots (not shown) for connecting to a plurality of studs 213. The studs 213 can provide backing for a first wallboard 230.

The wallboard 230 can be a gypsum drywall wallboard. The wallboard 230 can be attached (e.g., via nails, screws, or other fasteners) to the studs 213 of the head-of-wall assembly 200. The wallboard 230 can include an inner face 233 facing towards the studs 213. The wallboard 230 can include an outer face 231 facing outwardly away from the studs 213. The wallboard 230 can include an upper edge 232. The upper edge 232 can extend along a length of the wallboard 230 (e.g., into and out of the page as shown in FIG. 3).

The head-of-wall assembly 200 can define a deflection gap 215. The deflection gap 215 can be a gap across a portion of the head-of-wall assembly 200. The deflection gap 215 can be bounded on an upper side by the upper structure 210 and on a lower side by the upper edge 232. A height of the deflection gap 215 between the upper and lower sides can vary as the upper structure 210 moves with respect to the wallboard 230. The deflection gap 215 can be variable between a closed position and an open position. This movement of the deflection gap 215 can accommodate movement of the building.

The deflection gap 215 can define an opening through which fire, smoke, heat, and/or sound can pass from one side of the assembly 200 to the other side. Accordingly, the fire-rated assembly 100 can be installed in the assembly 200 to fire-block the deflection gap 215 (e.g., in accordance with UL-2079 regulations).

To install the assembly 100, the compressible block 104, the strip 105, and/or the third leg 103 can be placed within the deflection gap 215. The upper face 109*c* of the compressible block 104 can abut and seal against the upper structure 210. The deflection gap 215 can have a maximum height that is less than the height 104*a* of the compressible block 104. Accordingly, the compressible block 104 can be compressed to fit within the deflection gap 215. The compression can help to retain the compressible block 104 within the deflection gap 215. The compressible block can compress and expand to provide a seal across the deflection gap 215. The upper face 109*c* of the compressible block 104 can abut and seal against the upper structure 210. This can allow the assembly 100 to conform to an uneven surface of the upper structure 210.

The fire-blocking strip 105 can be located between the upper edge 232 and the upper structure 210. Accordingly, when heated to an intumescent expansion temperature (e.g., approximately 350° F.), as may occur during a fire, the fire-blocking strip 105 can expand to partially or completely fill the deflection gap 215 (e.g., across the height of the deflection gap 215) and thereby inhibit or prevent the passage of fire, heat, smoke and/or sound across the deflection gap 215.

The third leg 103 can be placed on the upper edge 232 of the wallboard 230. The third leg 103 can position the compressible block 104 and/or the strip 105 within the deflection gap. The vinyl material of the third leg 103 can maintain the position of the fire-blocking strip 105 when heated up to at least a melting point of the vinyl (e.g., approximately 500° F.). The melting point of the vinyl can be above the intumescent expansion temperature of the strip 105 (e.g., approximately 350° F.). Accordingly, the third leg 103 can maintain the position of the strip 105 within the deflection gap 215 at least until the strip 105 begins expansion.

The second leg 102 can be attached to the outer face 231 of the wallboard 230. The second leg 102 can be flush against an upper end of the wallboard 230 on the outer face 231. The second leg 102 can be attached to the upper end of the wallboard 230. The attachment can be by adhesive and/or mechanical fasteners. The second leg 102 can include apertures designed to receive mechanical fasteners therethrough for attachment with the wallboard 230.

The first leg 101 can be aligned with deflection gap 215. The first leg 101 can extend along a portion or an entirety of the height of the deflection gap 215. The first leg 101 can form an outer face blocking the deflection gap 215. In some configurations, the first leg 101 can contact the upper structure 210 at the distal end thereof.

The length 101*a* can be approximately equal to the height of the deflection gap 215, although this is not required. The flexible nature of the upper leg 101 can accommodate heights of the gap 215 that are less than the length 101*a*. As the deflection gap 215 varies with relative movement of the upper structure 210 and the wallboard 230, the first leg 101 can remain in contact with the upper structure 210, although this is not required. Accordingly, the first leg 101 can provide a barrier for the compressible block 104. The first leg 101 can extend the life of the compressible block 104 by protecting it from exposure to the elements and/or tampering.

The second leg 102 can be covered with a drywall mud (joint compound) or similar substance. The mud can fill the plurality of holes 107. The holes 107 can enhance the connection between the mud and the second leg 102. Once dried, the mud can be smoothed to mask the appearance of the second leg 102 against the outer surface 231 of the wallboard 230. The dried and smoothed mud can align with the first leg 101 at the offset of the intersection 110*a* (e.g., because of the offset between the first leg 101 and the second leg 102). The dried and smoothed mud can be painted to match the rest of the outer face 231.

In certain implementations, the head-of-wall assembly 200 can be first assembled. Afterwards, the fire-rated assembly 100 can be installed within the deflection gap 215. The second leg 102 can then be covered with the mud, smoothed and painted. In certain implementations, the fire-rated assembly 100 can be pre-installed on the wallboard 230. The head-of-wall assembly 200 can then be assembled with the assembly 100 located in the deflection gap 215. The head-of-wall assembly 400 can be a one hour fire-rated wall assembly.

The assembly 200 can also include a second side having a second wallboard 230A and a second deflection gap 215A. The second deflection gap 215A can be fire-blocked with a second fire-rated assembly 100A in the same manner as described above.

Figure 4:
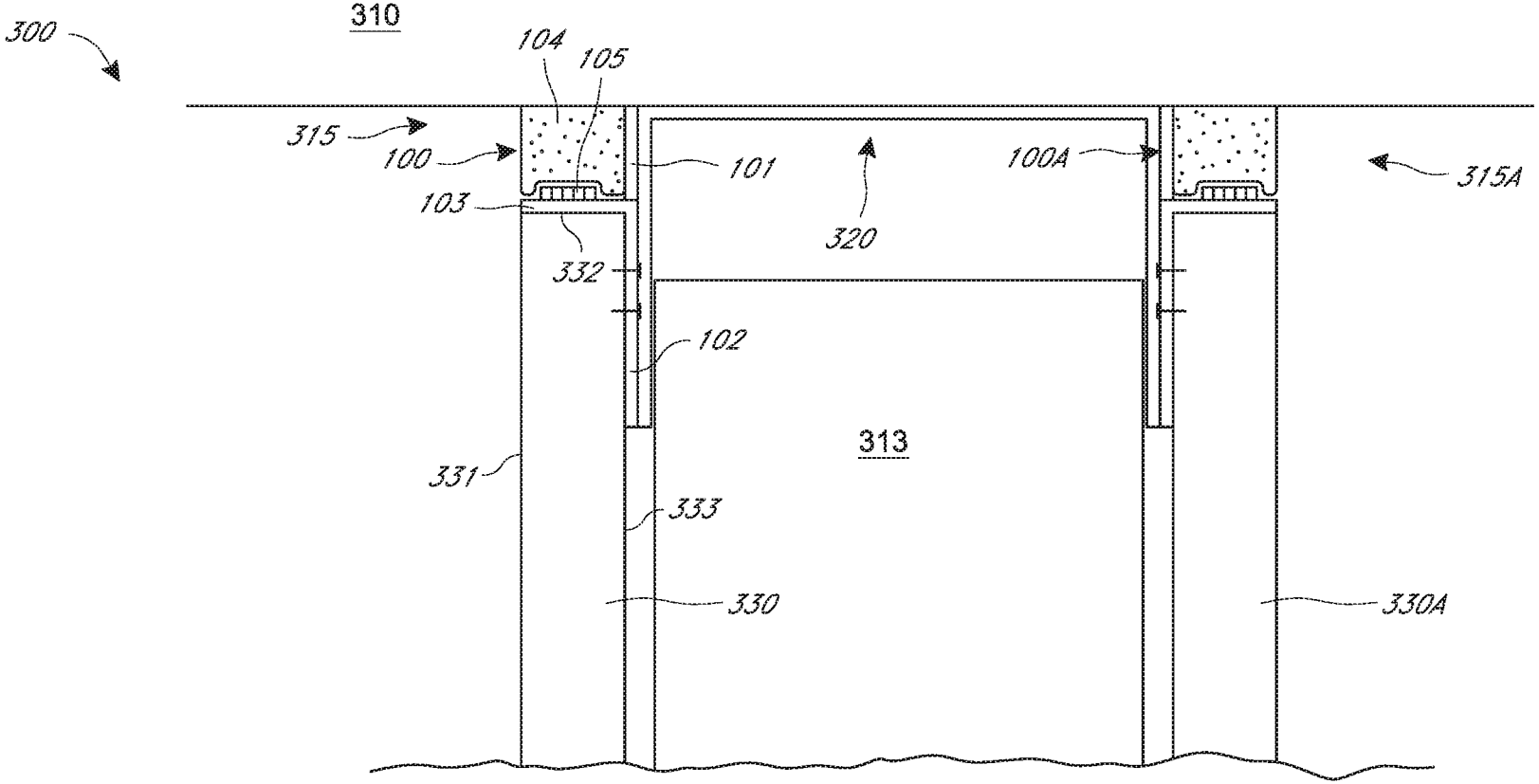
FIG. 4 shows another configuration of a head-of-wall assembly including the fire-rated assembly of FIG. 1.

A head-of-wall assembly 300, as shown in FIG. 4 can include the same general structures as the head-of-wall assembly 200. The head-of-wall assembly 300 can include an upper structure 310, a header track 320, one or more studs 313, and a wallboard 330. The wallboard 330 can include an outer surface 331, an inner surface 333, and/or an upper edge 332. A deflection gap 315 can be defined between the upper structure 310 and the upper edge 332.

In assembly 300, the profile assembly 100 is installed with the second leg 102 against the inner surface 333 of the wallboard 330. In this configuration, the assembly 100 can be pre-installed on the wallboard 330 and the wallboard can afterwards be assembled into the assembly 300. When the assembly 300 is fully assembled, the second leg 102 can be located between the inner surface 333 and the first leg 331 of the header track 320. The first leg 101 can be located at or within the deflection gap 315 and/or contact the upper structure 310. The compressible block 104 and the third leg 103 can be located within the deflection gap 315. The third leg 103 can be located against the upper edge 332. The compressible block 104 can be compressed to contact and/or seal against the upper structure 310.

This configuration can substantially decrease the amount of time required for installing the fire-rated assembly 100 in the assembly 300. All wallboards 330 can have the fire-rated assembly 100 pre-installed. Afterwards, the installation of the wallboard 330 (e.g., attaching to the studs 313) can be carried out following a normal procedure, such as that described above. Moreover, the second leg 102 can be hidden inside the assembly 300 such that no joint compound/paint is required to mask its appearance. In certain implementations, the first leg 101 can be aligned with the second leg 102, although this is not required.

The assembly 300 can also include a second side having a second wallboard 330A and a second deflection gap 315A. The second deflection gap 315A can be fire-blocked with a second fire-rated assembly 100A in a manner similar to that described above.

Figure 5:
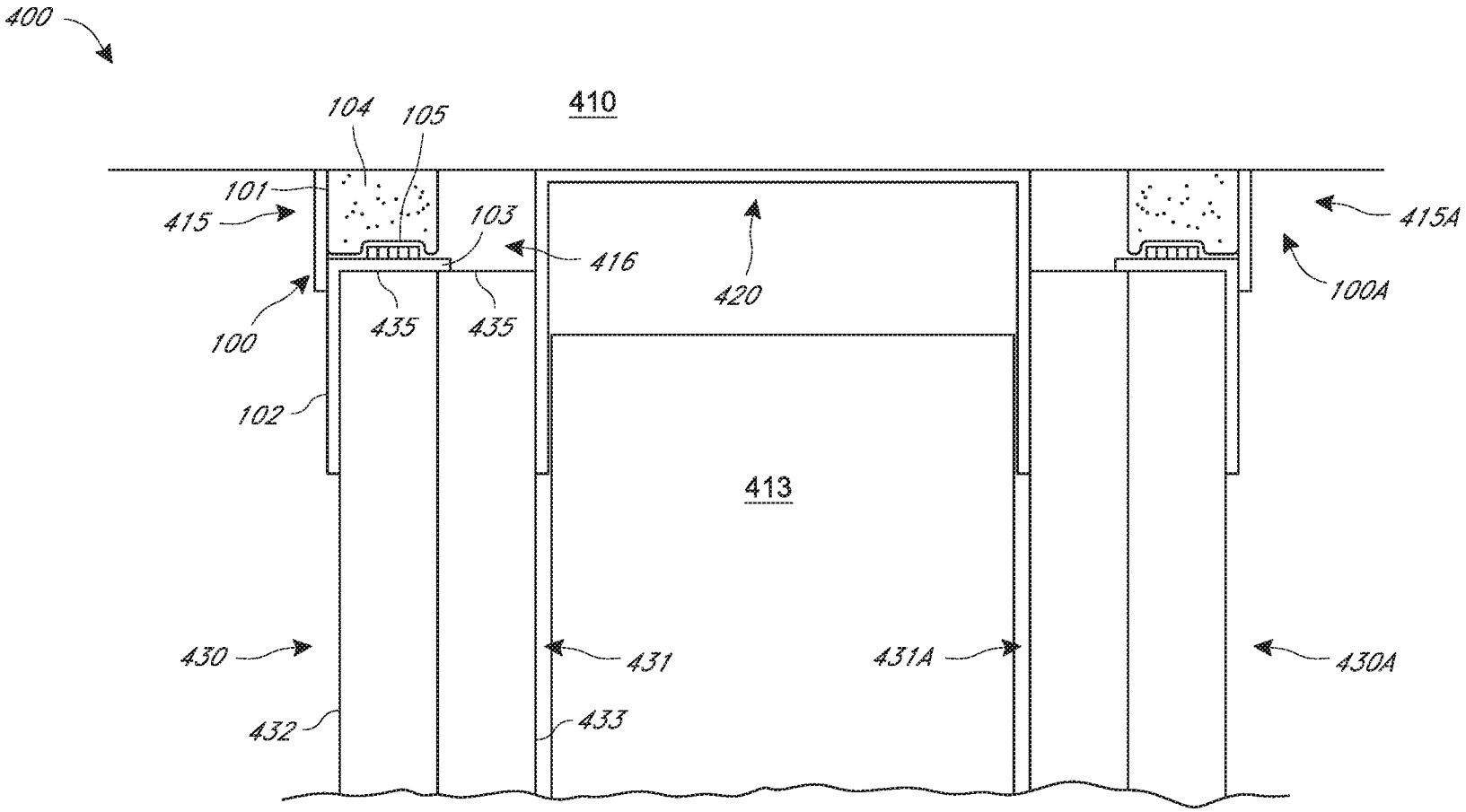
FIG. 5 shows another configuration of a head-of-wall assembly including the fire-rated assembly of FIG. 1.

FIG. 5 shows another head-of-wall assembly 400. The head-of-wall assembly 400 can include an upper structure 410, a header track 420, and one or more studs 413. The head-of-wall assembly 400 can include a first wallboard 430 and a second wallboard 431. The first wallboard 430 can be an outer wallboard and the second wallboard 431 can be an inner wallboard. The first wallboard 431 can include an outer face 432. The second wallboard 431 can include an inner face 433. The first and/or second wallboards 430, 431, can define an upper edge 435. The head-of-wall assembly 400 can define a deflection gap 415 between the upper edge(s) 435 and the upper structure 410. The head-of-wall assembly 400 can be a two hour fire-rated wall assembly 400.

The fire-rated assembly 100 can be installed within the deflection gap 415. The third leg 103 can be placed against the upper edge(s) 435. The compressible block 104 can be compressed against the upper structure 410. The second leg 102 can be pressed against the outer face 432 of the first wallboard 430, and the first leg 101 can block the deflection gap 415.

As shown, the deflection gap 415 includes an empty space 416. The empty space 416 can be located between the wallboard 431 and the upper structure 410. Alternatively, this can be filled by the compressible block 104, the fire-blocking strip 105, the third leg 103 and/or another material. The empty space 416 can form an insulation space that slows the transfer of heat across the head-of-wall assembly 400.

A second side of the assembly 400 can include a deflection gap 415A, a second fire-rated assembly 100A, an outer wallboard 430A, and an inner wall 431A. The second fire-rated assembly 101A can be attached within the deflection gap 415A, as described above.

Figure 6:
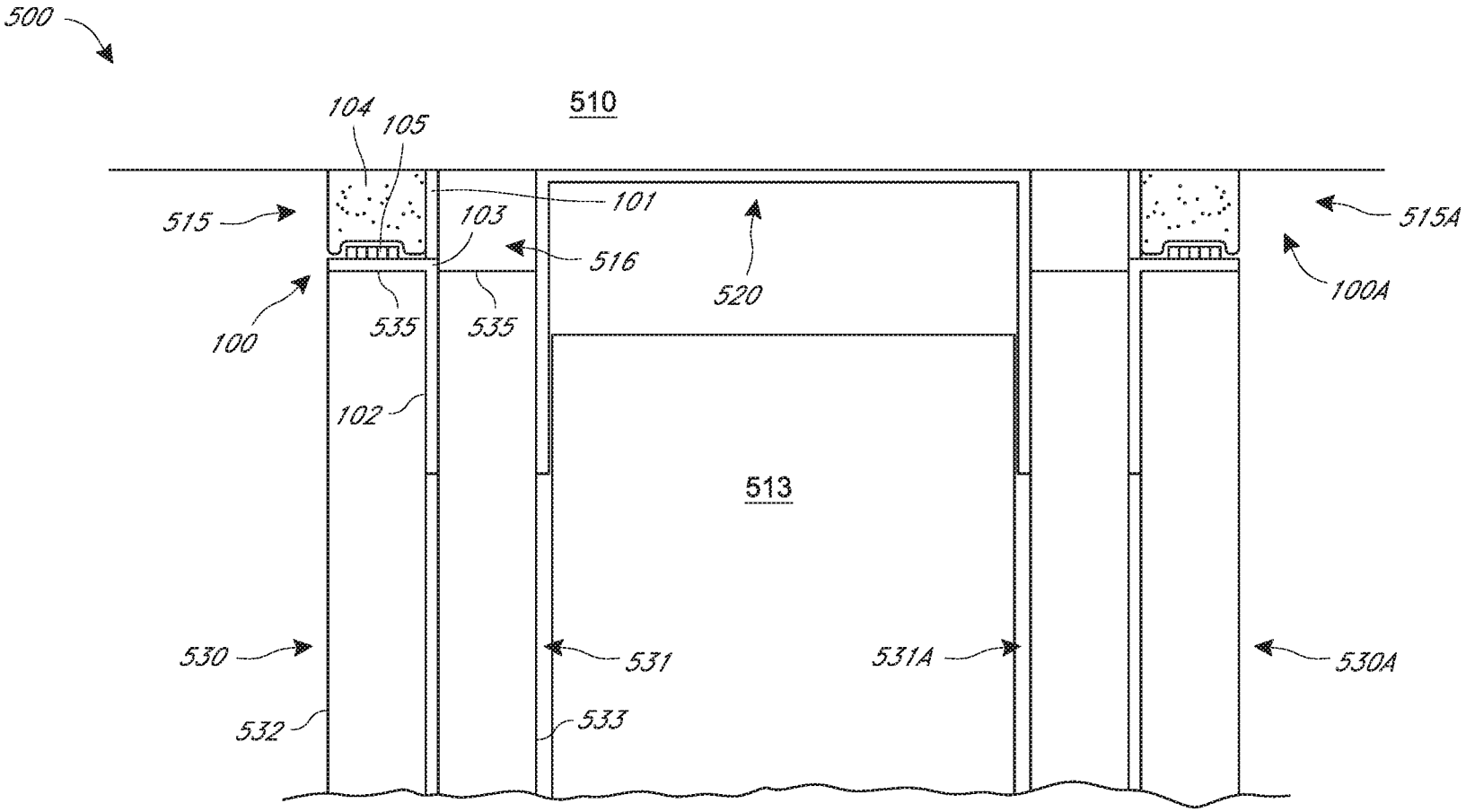
FIG. 6 shows another configuration of a head-of-wall assembly including the fire-rated assembly of FIG. 1.

FIG. 6 shows another embodiment of a head-of-wall assembly 500. The head-of-wall assembly 500 can be similar to the head-of-wall assembly 400 with a different installation configuration of the assembly 100. The head-of-wall assembly 500 can include an upper structure 510, a header track 520, one or more studs 513, an outer wallboard 530, an inner wallboard 531, an outer face 532, an inner face 533, an upper edge 535, and a deflection gap 515.

The compressible material 104, the strip 105 and the third leg 103 can be placed within the deflection gap 515. The second leg 102 of the assembly 100 can be located between the first wallboard 530 and the second wallboard 531. The second leg 102 can be pre-installed on either of the first or second wallboards 530, 531. The compressible material 104 can be faced either outwardly towards the outer face 532, as shown, or inwardly towards the header track 520 and the inner face 533. The compressible block 104, the first leg 101, and/or the fire-blocking strip 105 can fire-block the deflection gap 515.

The fire-rated assembly 100 can be pre-installed on either of the wallboards 530, 531. Moreover, the second leg 102 can be hidden inside the assembly 500 such that no mud/paint is required to mask its appearance. In certain implementations, the first leg 101 can be aligned with the second leg 102, although this is not required.

A second side of the head-of-wall assembly 500 can similarly include a deflection gap 515A, a second fire-rated assembly 100A, an outer wallboard 530A, and an inner wallboard 531A. The fire-rated assembly 100A can be installed within the deflection gap 515A in the same manner as described in relation to the deflection gap 515.

Figure 7:
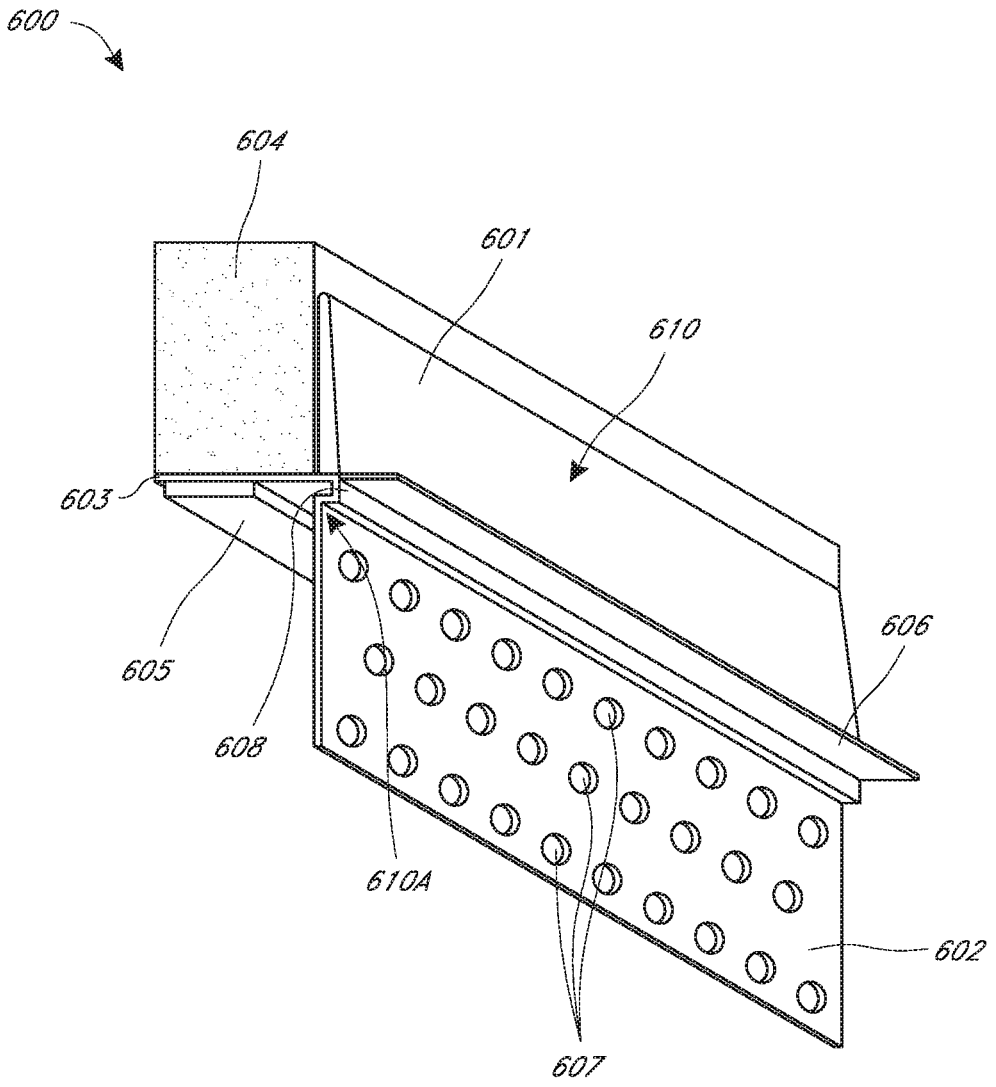
FIG. 7 shows a perspective view of another fire-rated assembly.
Figure 8:
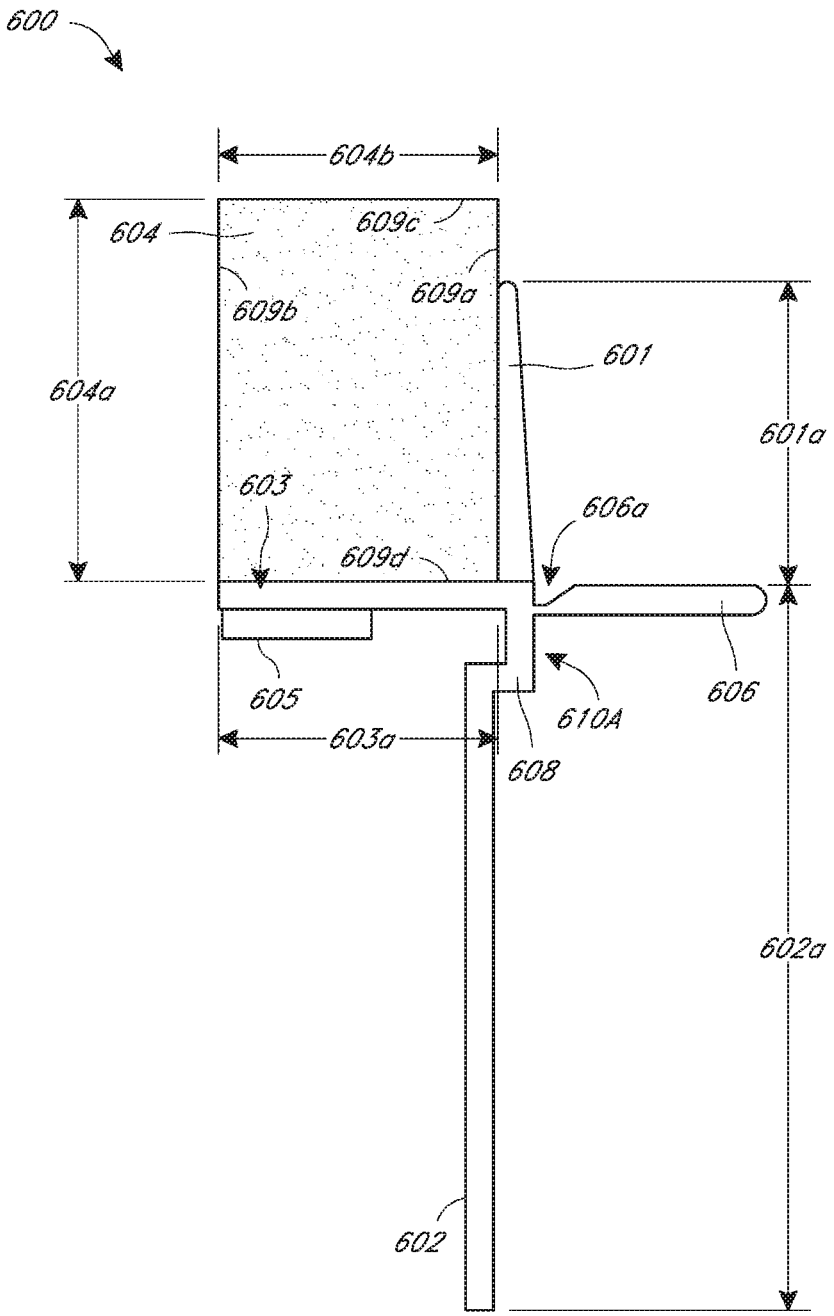
FIG. 8 shows an end view of the fire-rated assembly of FIG. 7.

FIGS. 7 and 8 shows another embodiment of a fire-rated assembly 600. The assembly 600 can extend along a length (e.g., a standard length, as noted above). The cross-sectional shape of the assembly 600 can be uniform along the length. The assembly 600 can include a profile 610. The profile 610 can comprise a vinyl material (e.g., PVC). The profile 610 can comprise a first leg 601, a second leg 602 and/or a third leg 603. The first leg 601, second leg 602, and/or third leg 603 can meet at an intersection 610*a*. The profile 610 can be formed of a single, unitary material or multiple different materials connected together (e.g., through a co-extrusion process).

The first leg 601 can extend upwardly from the intersection 610*a*. The first leg 601 can comprise a flexible material. The second leg 602 can extend downwardly from the intersection 610*a*. The second leg 602 can comprise a plurality of holes 607. The holes 607 can be arranged in a pattern along a length of the profile 600. The third leg 603 can extend horizontally with respect to the intersection 610*a*. The intersection 610*a* can include a protrusion 608. The protrusion 608 can offset the second leg 602 from the first leg 601.

The profile 610 can include a joint compound and/or paint guard 606. The guard 606 can attach at the intersection 610*a* (e.g., at the protrusion 608 and/or between the second leg 602 and the first leg 601). The guard 606 can be aligned with the third leg 603. The guard 606 can be attached at a frangible portion 606*a*. The profile 610 can be formed as an integral unit including the first, second, and third legs 601-603 and the paint guard 606. Alternatively, any of the legs 601-603 or paint guard 606 can be connected with another portion or the remainder of the profile 610.

A compressible block 604 can be attached to the third leg 603 and/or the first leg 601. The compressible block 604 can comprise an open or closed cell foam material. The compressible block 604 can be attached to an inner face of the first leg 601 and/or an upper face of the third leg 603. The compressible block 604 can extend the length of the assembly 600.

The fire-rated assembly 600 can include a fire-blocking strip 605. The fire-blocking strip 605 can be attached to the third leg 603. The fire-blocking strip 605 can be located on a lower surface or the upper surface of the third leg 603. Attaching the fire-blocking strip 605 to the lower surface of the third leg 603 can ease assembly because the compressible block 604 does not have to be assembled over the strip 605. The fire-blocking strip 605 can be adhered to the third leg 603. The fire-blocking strip 605 can be located anywhere along the third leg 603, such as adjacent to the second leg 602, the distal end of the third leg or therebetween. Alternatively or in addition, the strip 605 can be attached to the first leg 601 on an inner side thereof or otherwise to the compressible block 604. The strip 605 can extend the length of the assembly 600. The strip 605 can be or comprise an intumescent material.

The first leg 601 can have a height or length 601*a* in a cross-sectional direction. The length 601*a* can extend from the intersection 610*a* (e.g., the third leg 603 or protrusion 608) to a distal end of the first leg 601. The first leg 601 can be tapered in thickness towards the distal end. The length 601*a* can be ⅝". In certain implementations, the length 601*a* can be between approximately ¼" and 1½". The second leg 602 can have a height or length 602*a* in the cross-sectional direction. The length 602*a* can extend from the intersection 610*a* (e.g., the third leg 603 or protrusion 608) to a distal end of the second leg 602. The length 602*a* can be between approximately ½" and 3". The third leg 603 can include a width or length 603*a* in the cross-sectional direction. The length 603*a* can extend from the intersection 610*a* (e.g., the second leg 602 or the first leg 601) to a distal end of the third leg 603. The length 603*a* can be ⅝". The length 603*a* can be between approximately ¼" and 1½".

The protrusion 608 is further shown in FIG. 8. The protrusion 608 can at least partially or fully offset the second leg 602 from the first leg 601. The protrusion 608 can include one or more vertical and/or horizontal segments (e.g., L-shaped segments) of the profile 610 that offset the second leg 602 from the first leg 601. In certain implementations, the first leg 601 and the second leg 602 can be aligned.

The compressible block 604 can have a height 604*a*. The height 604*a* can be approximately 1". In certain implementations, the height 604*a* can be between approximately ½" and 2". The height 604*a* can be greater than the length 601*a*. Desirably, the height 604*a* is greater than the length 601*a* such that the compressible block 604 extends beyond the distal end of the first leg 601 to provide contact with or a seal against an upper surface, as described above and further below.

The compressible block 604 can include a width 604*b*. The width 604*b* can be approximately ½". The width 604*b* can be between approximately ¼" and 1½". In certain implementations, the width 604*b* can match the length 603*a*. The compressible block 604 can include a front face 609*a*, a rear face 609*b*, an upper face 609*c*, and/or a lower face 609*d*. The rear face 609*b* of the compressible block 604 can extend beyond the distal end of the third leg 603 or vice versa. The front face 609*a* can abut and/or attach to the first leg 601. The lower face 609*d* can attach to the third leg 603.

The guard 606 can attach at the frangible portion 606*a* with the profile 610. The frangible portion 606*a* can be located between the first leg 601 and the second leg 602. The frangible portion 606*a* can align generally with the third leg 603. The frangible portion 606*a* can comprise a thin portion of the material of the profile 610.

Figure 9:
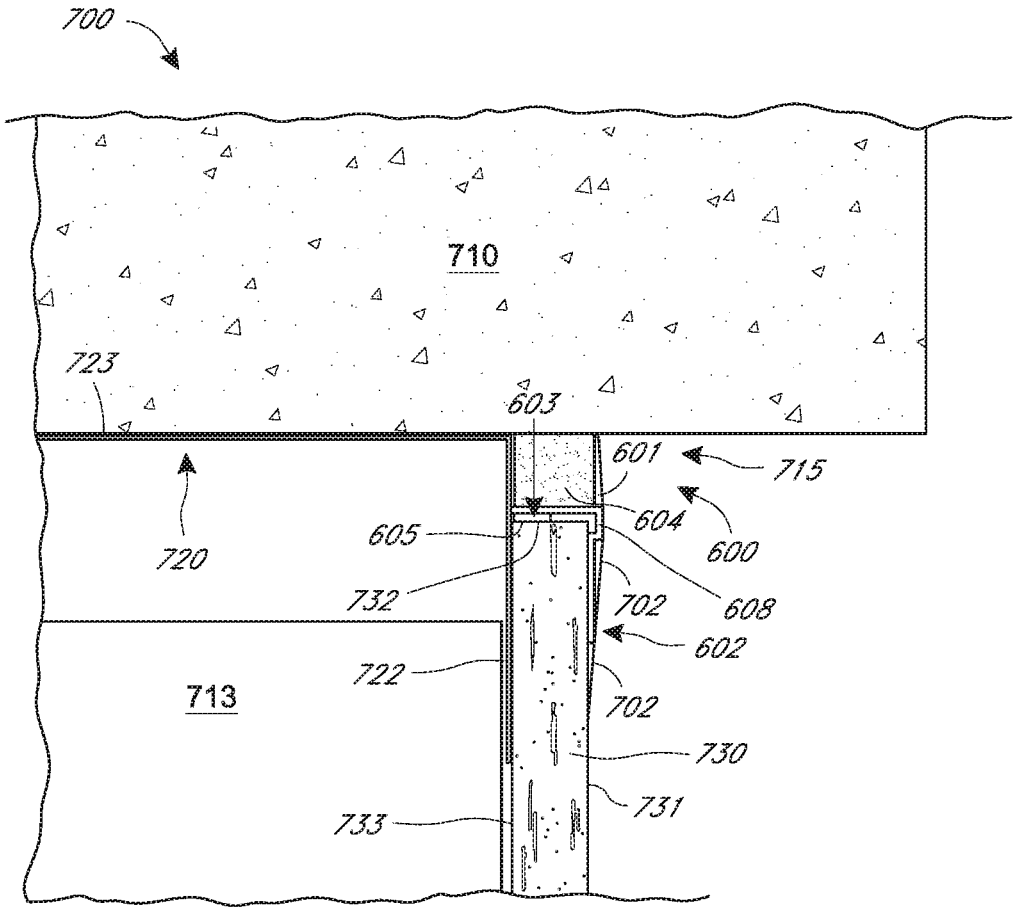
FIG. 9 shows a cross-sectional view of a head-of-wall assembly including the fire-rated assembly of FIG. 7.

FIG. 9 shows a head-of-wall assembly 700. The head-of-wall assembly 700 can include an upper structure 710. The head-of-wall assembly 700 can include a header track 720. The header track 720 can include a web 723 and a pair of slotted flanges or legs 722 (only one shown). The web 723 can be attached to the upper structure 710. The assembly 700 can include one or more studs 713. The stud(s) 713 can be attached to the slotted flange 722.

The assembly 700 can include a wallboard 730. The wallboard 730 can include an outer face 731. The wallboard 730 can include an inner face 733. The wallboard 730 can include an upper edge 732. The wallboard 730 can attached to the stud 713. The connection between the header track 720 and the stud(s) 713 can allow vertical movement between the wallboard 730 and the upper structure 710. The vertical movement can open and close a deflection gap 715. The deflection gap 715 can be located between the upper structure 710 and the upper edge 732 of the wall board 730. The fire-rated assembly 600 can be installed in the assembly 700 to provide protection against fire, smoke, heat, and/or sound across the deflection gap 715.

To install the fire-rated assembly 600, the compressible block 604, the strip 605 and/or the third leg 603 can be placed within the deflection gap 715. The compressible block 604 can be installed within the deflection gap 715 in a compressed configuration. Expansion of the compressible block 604 can contact and/or seal against the upper structure 710 even if the surface of the upper structure 710 is uneven. The strip 605 can be located between the upper edge 732 and the upper structure 710. The third leg 603 can be located at least partially within the deflection gap 715.

The third leg 603 can position the strip 605 and/or the compressible block 604 within the deflection gap 715. The third leg 603 can comprise a material having a melting temperature above a intumescent expansion temperature of the strip 605. Accordingly, when the assembly 700 is exposed to fire, heat, and/or smoke, the third leg 603 can maintain the position of the strip 605 (e.g., within the deflection gap 715) until the fire blocking material at least partially expands to fill and/or seal across the deflection gap 715.

The second leg 602 can be attached to the outer surface 731 of the wallboard 730, such as by an adhesive or a plurality of mechanical fasteners. The second leg 602 can be flush against the outer surface 731.

The distal end of the first leg 601 can contact the upper structure 710, although this is not required. The flexible nature of the first leg 601 and the compressibility of the foam 604 can allow movement of the deflection gap 715. As the deflection gap 715 varies with relative movement of the upper structure 710 and the wallboard 730, the first leg 601 can remain in contact with the upper structure 710, although this is not required. The first leg 601 can provide a barrier for protecting the compressible block 604. This can extend the life of the compressible block 604 by protecting it from exposure to the elements and/or tampering.

The protrusion 608 can align the first leg 601 generally more outwardly from the outer face 731 of the wallboard 730. Accordingly, the addition of a joint compound 702 over the second leg 602 can align with the projection 608. Once dried, the joint compound 702 can be smoothed to align with the end of the protrusion 608. This can create a smoother appearance for the finished assembly 700. The joint compound 702 and/or first leg 601 can be painted to match the rest of the wall.

The guard 606 can remain in place until the joint compound 702 is applied to the second leg 602. The guard 606 can be removed along the frangible portion 606*a*. Then the remaining joint compound 702 can be sanded and painted along with the first leg 601 to mask the appearance of the fire-rated assembly 600 within the deflection gap 715. Alternatively, the guard 606 can remain in place until the joint compound 702 is smoothed and/or painted.

In certain other implementations, the fire-rated assembly 600 can be preinstalled with the second leg 603 attached to the inner surface 733, similar to the installation shown in head-of-wall assembly 300. In another implementation, the fire-rated assembly 600 can be installed in a head-of-wall assembly including multiple wallboards. The fire-rated assembly 600 can be installed within the multiple wallboards as described above in relation to FIGS. 5 and 6, showing installation of the fire-rated assembly 100.

FIGS. 10-13 illustrate a construction accessory 1000, portions of the construction accessory 1000, and a wall assembly 1500 incorporating a pair of the construction accessories 1000. The construction accessory 1000 is well-suited for the use of mineral wool or a similar material to be used as a fire-resistant material. In some configurations, the construction accessory 1000 incorporates a mineral wool or similar material. However, the construction accessory 1000 can incorporate intumescent material as a fire-resistant material, alone or in combination with a mineral wool or similar material. Although shown in the context of a head-of-wall joint, the construction accessory 1000 can be used in, or modified for use in, any wall joint (e.g., head of wall, bottom of wall, or vertical wall to wall joints) or other similar joint to provide the joint with a fire rating (e.g., according to UL-2079) or a sound rating (e.g., an STC rating).

Mineral wool is a well-known material for use in fire-blocking applications. Mineral wool is available from a plurality of manufacturers and is relatively cheap compared to intumescent materials. Mineral wool is a fibrous material formed by spinning or drawing molten mineral or rock materials, such as slag and ceramics. Mineral wool is also known as mineral fiber, mineral cotton, man-made mineral fibre (MMMF), and man-made vitreous fiber (MMVF). Mineral wool has advantageous fire blocking characteristics, but it is can be a difficult material with which to work. The material itself can be very itchy to handle and is an irritant to bare skin. It can also pull apart quite easily and is not very durable when left unprotected or exposed. When mineral wool is used in conventional head-of-wall joint protection, the mineral wool is typically covered with a wet spray-applied elastomeric coating. The elastomeric coating conceals the mineral wool and protects it from exposure and from falling apart or falling out of the head of wall joint. However, the process of applying the elastomeric coating is time consuming. In addition, the elastomeric coating tends to dry out over time and loses its initial flexibility.

The illustrated construction accessory 1000 provides for the use of mineral wool in a fire-blocking application while avoiding some or all of the above-mentioned shortcomings of conventional mineral wool-protected joints. The illustrate construction accessory 1000 is a finishing drywall accessory that provides a flexible protective vinyl (e.g., PVC) or similar material covering over a mineral wool member. Accordingly, the illustrated construction accessory 1000 can be used in fire rating building joints. The illustrated composite fire-rated drywall accessory 1000 combines the fire blocking attributes of mineral wool with the flexibility and printability of a vinyl/PVC finishing drywall accessory.

In some configurations, the construction accessory 1000 includes an elongate body portion or profile 1002. The profile 1002 can be similar to the other profiles described herein. In particular, the profile 1002 can be an elongate member. The profile 1002 can have a consistent cross-sectional shape along its entire length. In some configurations, the profile 1002 includes an L-shaped portion defined by a first leg 1004 or wall-face leg and a second leg 1006 or wall-end leg. Thus, the first leg 1004 and the second leg 1006 can be oriented at an angle relative to one another, such as a perpendicular or generally perpendicular angle. When the construction accessory 1000 is used in a head-of-wall gap 1502 of the wall assembly 1500, the first leg 1004 is oriented in a vertical direction and the second leg 1006 is oriented in a horizontal direction.

Figure 10:
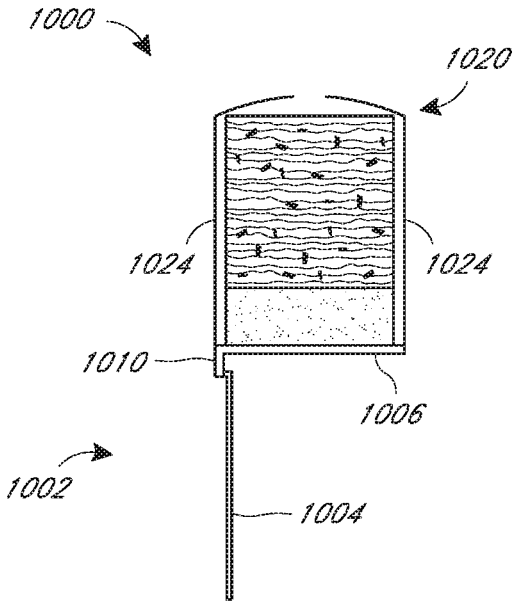
FIG. 10 is an end view of a construction accessory with a compressible fire blocking member located between flexible legs.
Figure 11:
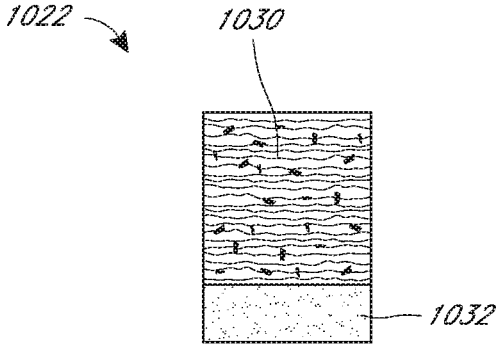
FIG. 11 is an end view of the compressible fire blocking member of the construction accessory of FIG. 10 shown separate from the remainder of the construction accessory. The illustrated compressible fire blocking member is a composite of mineral wool and compressible open or closed cell polyethylene foam.

In some configurations, the first leg 1004 can be directly connected to the second leg 1006. However, in the illustrated arrangement, the first leg 1004 and the second leg 1006 are connected by a protrusion 1010, which offsets the first leg 1004 from an edge of the second leg 1006. The offset can be configured to provide a space to accommodate joint compound that covers the first leg 1004. The protrusion 1010 can have a substantial U-shape in cross-section. As illustrated in FIG. 10, the profile 1002 can include a joint compound and/or paint guard 1008, which can be the same as or similar to the joint compound and/or paint guard 606 described herein with respect to FIGS. 7 and 8.

The profile 1002 also includes an upper portion or gap portion in the form of a flexible enclosure 1020 that at least partially defines a space for receiving a compressible fire-blocking member 1022. The flexible enclosure 1020 is positioned along or encloses three sides of the compressible fire-blocking member 1022. In some configurations, the second leg 1006 is positioned along a fourth side of the compressible fire-blocking member 1022 and cooperates with the flexible enclosure 1020 to define the space for receiving the compressible fire-blocking member 1022.

In the illustrated arrangement, the flexible enclosure 1020 is defined by a pair of flexible legs 1024. The flexible legs 1024 are spaced apart from one another along a width of the second leg 1006 and extend in a direction away from the first leg 1004. In some configurations, the flexible legs 1024 can be located at or adjacent opposing edges of the second leg 1006. In other configurations, one or both of the legs 1024 can be spaced from the edge of the second leg 1006. For example, in an accessory 1000 configured for use with multiple layers of wallboard, one of the flexible legs 1024 can be located adjacent the edge nearest the protrusion 1010 and the other of the flexible legs 1024 can be spaced inwardly from the opposite edge of the second leg 1006. Alternatively, both of the flexible legs 1024 can be spaced inwardly from the edges of the second leg 1006.

In the illustrated arrangement, the free ends (or edges) of the flexible legs 1024 are bent towards each other such that the free ends of the flexible legs 1024 are positioned closer to one another than the ends attached to the second leg 1006 of the profile 1002. Accordingly, the bent portions of the flexible legs 1024 can retain or assist in the retention of the compressible fire-blocking member 1022 within the space of the enclosure 1020. In some configurations, the free ends of the flexible legs 1024 can be spread apart to allow the compressible fire-blocking member 1022 to be inserted into the space of the enclosure 1020. In alternative arrangements, the enclosure 1020 can be defined by a single uninterrupted wall, which can have a free end (or edge) adjacent the second leg 1006 to allow for insertion of the compressible fire-blocking member 1022 into the space of the enclosure 1020. In other configurations, the single uninterrupted wall can be attached to the second leg 1006 at each end (or edge) and the compressible fire-blocking member 1022 can be inserted into the enclosure 1020 through an end of the enclosure 1020 at an end of the accessory 1000.

The profile 1002 can be constructed in a manner similar to those of the other components or accessories described herein. For example, the profile 1002 can be constructed as a unitary piece of a single material (e.g., vinyl or PVC) by a suitable process (e.g., extrusion). The first leg 1004 can include a plurality of apertures, similar to the apertures 607 to receive joint compound. The flexible legs 1024 can have a smaller wall thickness than one or both of the first leg 1004 and the second leg 1006 to provide the flexible legs 1024 with greater flexibility than one or both of the first leg 1004 and the second leg 1006. In other arrangements, the flexible legs 1024 can be constructed from a different (e.g., more flexible) material than the material of one or both of the first leg 1004 and the second leg 1006. Such an arrangement can be constructed from any suitable process, such as a co-extrusion process, for example.

The compressible fire-blocking member 1022 can be constructed from any suitable fire-blocking or fire-resistant material in order to achieve a desired level of fire protection. In some configurations, the compressible fire-blocking member 1022 includes a mineral wool material. In some configurations, the compressible fire-blocking member 1022 does not include an intumescent material. In the illustrated arrangement, the compressible fire-blocking member 1022 is a composite comprising a mineral wool material portion 1030 and a foam material portion 1032. The foam material portion 1032 can comprise an open cell foam material. In alternative arrangements, the foam material portion 1032 can comprise a closed cell foam material.

In the illustrated arrangement, the mineral wool material portion 1030 can be larger (greater cross-sectional area or greater volume) than the foam material portion 1032. For example, the mineral wool material portion 1030 can be twice as large or three times as large as the foam material portion 1032. In some configurations, the compressible fire-blocking member 1022 can have a width (direction along the second leg 1006) of about nine-sixteenths of an inch (9/16") and a height (direction away from the second leg 1006) of about one inch (1"). The mineral wool material portion 1030 can have a width of about nine-sixteenths of an inch (9/16") and a height of about three-quarters of an inch (3/4"). The foam material portion 1032 can have a width of about nine-sixteenths of an inch (9/16") and a height of about one-quarter of an inch (1/4").

Such an arrangement of the compressible fire-blocking member 1022 provides advantageous fire-blocking performance at a lower cost than relying on intumescent materials. In addition, providing the compressible fire-blocking member 1022 within the flexible enclosure 1020 overcomes several disadvantages of conventional methods and arrangements of using mineral wool materials. The mineral wool material portion 1030 can provide fire-blocking attributes and the foam material portion 1032 can provide resiliency to the compressible fire-blocking member 1022 to provide an expansion force tending to keep the mineral wool material portion 1030 (or the free ends of the flexible legs 1024) located towards or in contact with an adjacent structure, such as an overhead structure as described below.

Figure 12:
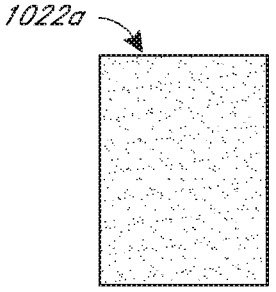
FIG. 12 is an end view of an alternative compressible sound blocking member that can be used in an alternative, sound-attenuation version of the construction accessory of FIG. 10. Side view of square open or closed cell polyethylene foam.

With reference to FIG. 12, an alternative compressible member **1022*a* can be provided for a sound-rated version of the construction accessory 1000. The compressible member 1022*a* of FIG. 12 comprises or is constructed entirely from an open cell foam material. The compressible member 1022*a* can omit mineral wool material and/or intumescent material. The compressible member 1022*a* can provide increased resistance to sound transmission relative to an open gap. The dimensions of the construction accessory 1000 can be the same as or similar to the dimensions described above with respect to the compressible fire-blocking member 1022**.

Figure 13:
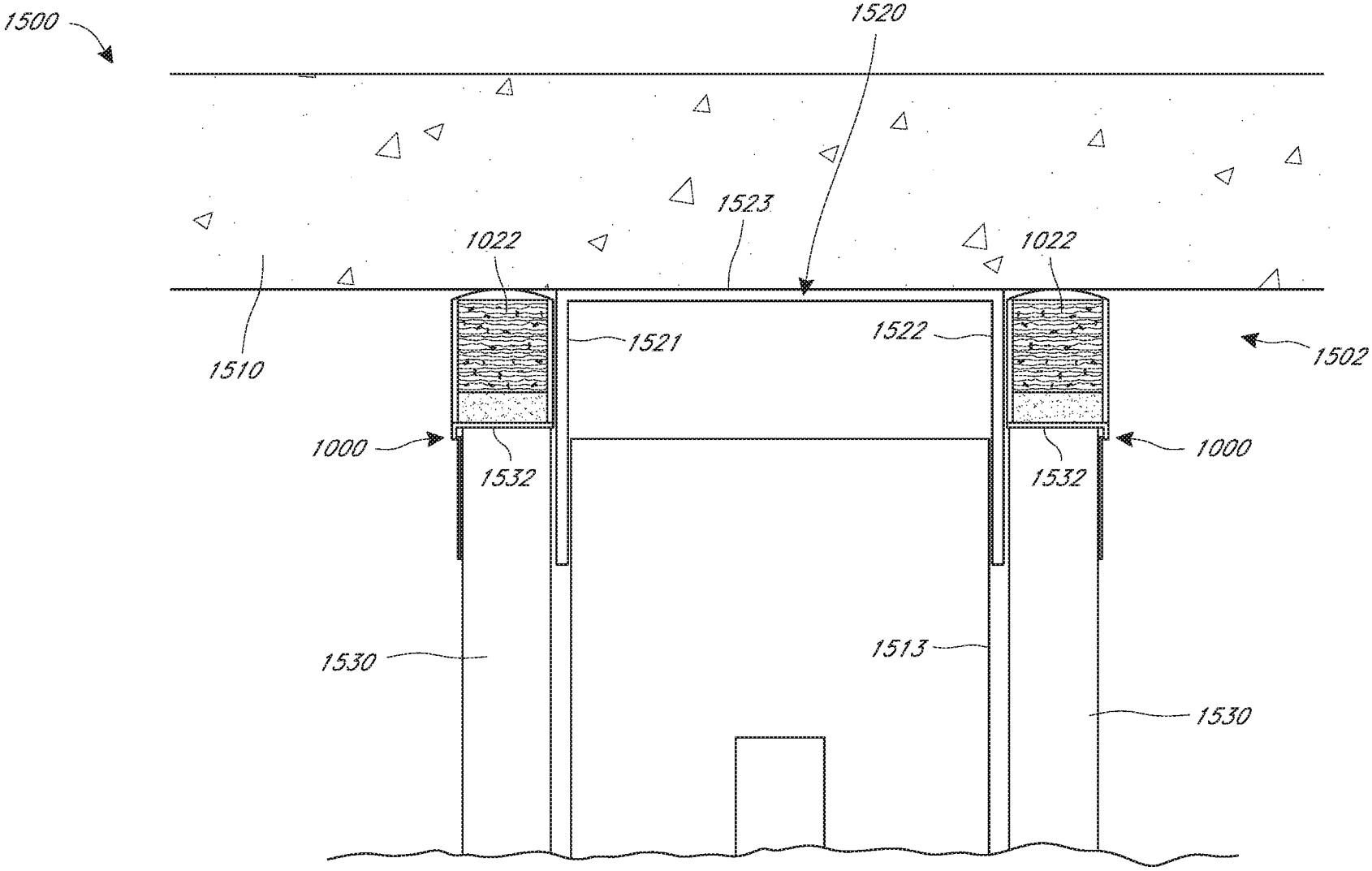
FIG. 13 is a cross-sectional view of a head-of-wall portion of a wall assembly with a pair of the construction accessory located within the head of wall gap.

With reference to FIG. 13, the illustrated wall assembly 1500 includes a pair of the construction accessories 1000 installed on each side of the wall assembly 1500 in the head-of-wall (e.g., deflection) gap 1502. However, as noted above, the construction accessory 1000 can be used in any other wall gap and possibly in other construction gaps. The wall assembly 1500 includes or is located adjacent to an upper or overhead structure 1510 defining an upper surface. The upper structure 1510 can be a ceiling or a floor of an upper level of a multi-level building. The wall assembly 1500 can include a header track 1520. The header track 1520 can include first and second flanges 1521, 1522. The first and second flanges 1521, 1522 can be connected by a web 1523. The header track 1520 can be generally U-shaped. The flanges 1521, 1522 can include apertures or slots (not shown) for connecting to a plurality of studs 1513. The studs 1513 can provide support for a wall material, such as one or more wallboards 1530, on each side of the wall assembly 1500.

The wallboard 1530 can be a gypsum drywall wallboard. The wallboard 1530 can be attached (e.g., via nails, screws, or other fasteners) to the studs 1513 of the wall assembly 1500. The wallboard 1530 can include an inner face facing towards the studs 1513. The wallboard 1530 can include an outer face facing outwardly away from the studs 1513. The wallboard 1530 can include an upper edge 1532. The upper edge 1532 can extend along a length of the wallboard 1530 (e.g., into and out of the page as shown in FIG. 13).

The wall assembly 1500 can define a head-of-wall gap or a deflection gap 1502. The deflection gap 1502 can be a gap across a portion of the wall assembly 1500. The deflection gap 1502 can be bounded on an upper side by the upper structure 1510 and on a lower side by the upper edge 1532.

A height of the deflection gap 1502 between the upper and lower sides can vary as the upper structure 1510 moves with respect to the wallboard 1530. The deflection gap 1502 can be variable between a closed position and an open position. This movement of the deflection gap 1502 can accommodate movement of the building.

The deflection gap 1502 can define an opening through which fire, smoke, heat, and/or sound can pass from one side of the wall assembly 1500 to the other side. Accordingly, the construction accessory 1000 can be installed in the wall assembly 1500 to fire-block the deflection gap 1502 (e.g., in accordance with UL-2079 regulations).

To install the construction accessory 1000, the compressible fire-blocking member 1022 (or compressible member 1022*a*), the flexible enclosure 1020, and/or the second leg 1006 can be placed within the deflection gap 1502. The flexible enclosure 1020 and/or the compressible fire-blocking member 1022 (or compressible member 1022*a*) can abut and/or seal against the upper structure 1510. The deflection gap 1502 can have a maximum height that is less than a height of the compressible fire-blocking member 1022 (or compressible member 1022*a*). Accordingly, the compressible fire-blocking member 1022 (or compressible member 1022*a*) can be compressed to fit within the deflection gap 1502. The compression can help to retain the compressible fire-blocking member 1022 (or compressible member 1022*a*) within the deflection gap 1502. The compressible fire-blocking member 1022 (or compressible member 1022*a*), and especially the foam material portion 1032, can compress and expand to provide a seal across the deflection gap 1502. The compressibility can also allow the construction accessory 1000 to conform to an uneven surface of the upper structure 1510.

Figure 14A:
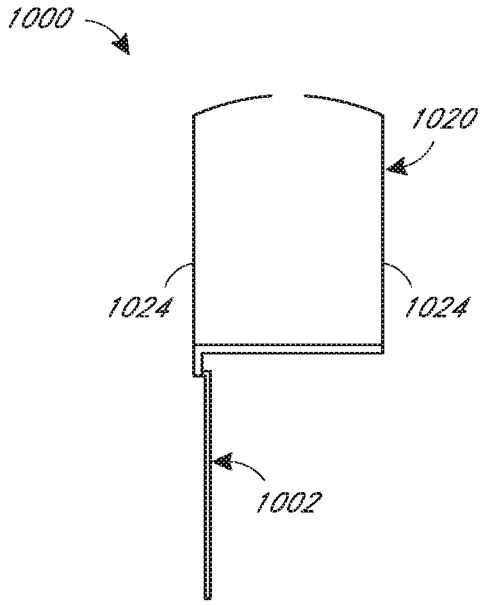
FIG. 14*a* is an end view of a profile portion of the construction accessory of FIG. 10 without the compressible fire blocking member.
Figure 14B:
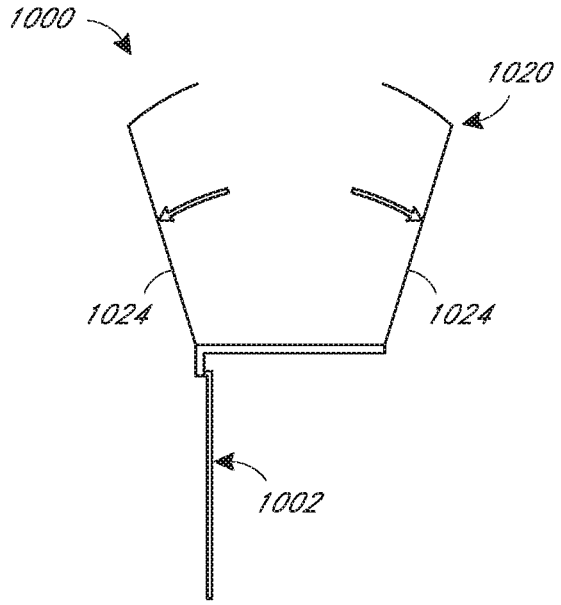
FIG. 14*b* is an end view of the profile portion of FIG. 14*a* with flexible legs opened to permit access to a space between the flexible legs.

With reference to FIGS. 14*a-d*, one example procedure for installation of the compressible fire-blocking member 1022 (or compressible member 1022*a*) into the space defined by the enclosure 1020 is illustrated. In FIG. 14*a*, the profile 1002 is shown prior to installation of the compressible fire-blocking member 1022 (or compressible member 1022*a*). As described above, the profile 1002 can be constructed in any suitable manners, such as by an extrusion process. Each of the flexible legs 1024 have a relaxed position configured to fully or substantially enclose the compressible fire-blocking member 1022 (or compressible member 1022*a*). As shown in FIG. 14*b*, the flexible legs 1024 can be flexed to separate their upper ends, creating an access opening to the interior space of the enclosure 1020.

Figure 14C:
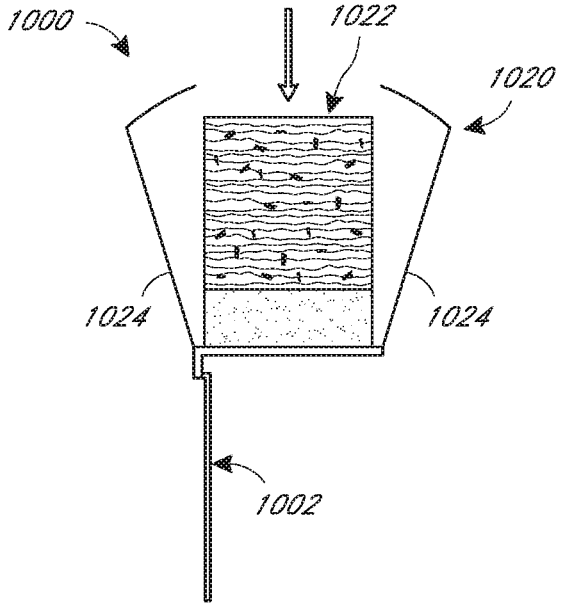
FIG. 14*c* is an end view of the profile portion of FIG. 14*a* with the flexible legs opened and the compressible fire blocking member inserted into the space between the flexible legs.
Figure 14D:
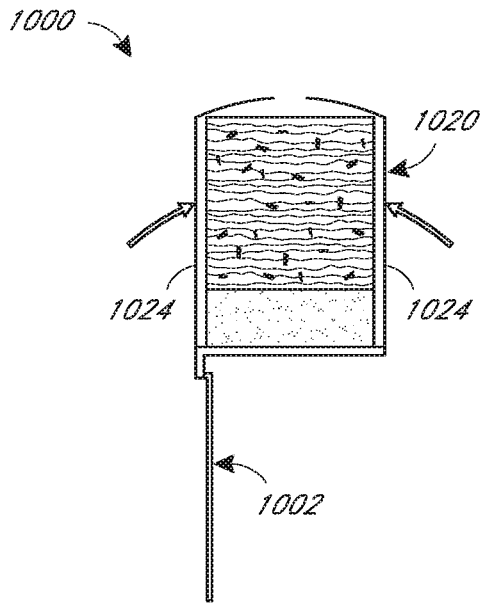
FIG. 14*d* is an end view of the profile portion of FIG. 14*a* with the compressible fire blocking member located in the space between the flexible legs and the flexible legs closed to retain the compressible fire blocking member.

As shown in FIG. 14*c*, with the flexible legs 1024 separated, the compressible fire-blocking member 1022 (or compressible member 1022*a*) can be inserted into the interior space of the enclosure 1020. As shown in FIG. 14*d*, once the compressible fire-blocking member 1022 (or compressible member 1022*a*) is positioned within the interior space of the enclosure 1020, the flexible legs 1024 can be allowed to return to their relaxed positions to capture the compressible fire-blocking member 1022 (or compressible member 1022*a*).

Advantageously, the flexible vinyl (or other plastic) legs 1024 are paintable, unlike mineral wool or intumescent foams that are not paintable. In addition, the vinyl (or plastic) material of the flexible legs 1024 will not dry out or lose its flexible characteristics and will provide the wall joint with a long useful life. Another benefit of the construction accessory 1000 is that it does not require any fire sealant or fire spray, both of which dry out over time and must be re-sealed to maintain satisfactory performance. Furthermore, the construction accessory 1000 has a long shelf life prior to installation, unlike fire sealants and sprays.

Certain Terminology

Terms of orientation used herein, such as "top," "bottom," "proximal," "distal," "longitudinal," "lateral," and "end," are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees. Given ranges are inclusive of endpoints.

Summary

Several illustrative embodiments of fire-rated assemblies have been disclosed. Although this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular embodiment of the inventions disclosed herein. No aspects of this disclosure are essential or indispensable. In many embodiments, the devices, systems, and methods may be configured differently than illustrated in the figures or description herein. For example, various functionalities provided by the illustrated modules can be combined, rearranged, added, or deleted. In some embodiments, additional or different processors or modules may perform some or all of the functionalities described with reference to the example embodiment described and illustrated in the figures. Many implementation variations are possible. Any of the features, structures, steps, or processes disclosed in this specification can be included in any embodiment.

In summary, various embodiments and examples of fire-rated assemblies and related methods have been disclosed. This disclosure extends beyond the specifically disclosed embodiments and examples to other alternative embodiments and/or other uses of the embodiments, as well as to certain modifications and equivalents thereof. Moreover, this disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims.

The invention claimed is:

1. An elongate component for placement within a deflection gap between an upper surface and an end of a wallboard in a head of wall assembly, the component comprising:

a wall-face leg configured to extend along a face of the wallboard;

a wall-end leg configured to extend along a top edge of the end of the wallboard, the wall-end leg being oriented perpendicular to the wall-face leg;

a flexible gap portion configured to be positioned within and extend along the deflection gap, the flexible gap portion extending in an opposite direction from the wall-face leg on an opposite side of the wall-end leg relative to the wall-face leg, the flexible gap portion configured to flex to vary a vertical dimension as a height of the deflection gap varies between an open position and a closed position;

a blocking element located in a space defined by the wall-end leg and the flexible gap portion, the blocking element configured to be positioned within the deflection gap and block fire and/or sound within the deflection gap;

wherein at least a portion of the flexible gap portion is located on an exterior side of the blocking element.

2. The component of claim 1, wherein the flexible gap portion comprises a single leg.

3. The component of claim 1, wherein the flexible gap portion comprises an enclosure.

4. The component of claim 3, wherein the enclosure comprises a pair of legs.

5. The component of claim 4, wherein each of the pair of legs comprises a bent free end.

6. The component of claim 5, wherein the blocking element comprises a mineral wool material.

7. The component of claim 6, wherein the blocking element further comprises a foam material.

8. The component of claim 1, wherein the blocking element comprises a combination of an intumescent material strip and a foam block.

9. The component of claim 8, wherein the intumescent material strip is attached to the wall-end leg.

10. The component of claim 8, wherein the foam block has a height that is greater than a height of the flexible gap portion.

11. The component of claim 1, wherein the blocking element comprises a mineral wool material.

12. The component of claim 11, wherein the blocking element further comprises a foam material.

13. A head of wall assembly defining the deflection gap, further comprising the component of claim 1 positioned in the deflection gap.

14. A method of making a component for placement in a wall gap, comprising:

forming an elongate profile comprising a first leg and a second leg that cooperate to form an L-shape in cross-section and a flexible enclosure defining an interior space, wherein the flexible enclosure comprises a pair of flexible legs;

positioning a blocking member within the interior space of the flexible enclosure; and separating the flexible legs and inserting the blocking member into the interior space between the flexible legs.

15. The method of claim 14, wherein the blocking member comprises a mineral wool material.

16. The method of claim 15, wherein the blocking member further comprises a foam material.

17. An elongate component for placement within a deflection gap between an upper surface and an edge of a wallboard in a head of wall assembly, the component comprising:

a wall-face leg configured to extend along an outer face of the wallboard;

a wall-end leg configured to extend along the edge of the wallboard, the wall-end leg being oriented perpendicular to the wall-face leg;

a flexible gap portion configured to be positioned within and extend along the deflection gap, the flexible gap portion extending in an opposite direction from the wall-face leg on an opposite side of the wall-end leg relative to the wall-face leg, the flexible gap portion configured to flex to vary a vertical dimension as a height of the deflection gap varies between an open position and a closed position;

a blocking element located in a space defined by the wall-end leg and the flexible gap portion, the blocking element configured to block fire and/or sound within the deflection gap;

wherein at least a portion of the flexible gap portion is located on an exterior side of the blocking.

18. The component of claim 17, wherein the blocking element comprises a combination of an intumescent material strip and a foam block.

19. The component of claim 17, wherein the wall-end leg comprises an intumescent material.

20. The component of claim 18, wherein the foam block has a height that is greater than a height of the flexible gap portion.

* * * * *